US009334465B2

(12) United States Patent
Fernandez Prieto et al.

(10) Patent No.: US 9,334,465 B2
(45) Date of Patent: May 10, 2016

(54) STRUCTURING USING AN EXTERNAL STRUCTURANT AND A COSMOTROPE

(71) Applicant: The Procter & Gamble Company, Cincinnati, OH (US)

(72) Inventors: Susana Fernandez Prieto, Benicarlo (BE); Johan Smets, Lubbeek (BE); Vincent Josep Nebot Carda, Vila Real (ES); Beatriu Escuder Gil, Sant Mateu (ES); Juan Felipe Miravet-Celades, Castellon (ES)

(73) Assignee: The Procter & Gamble Company, Cincinnati, OH (US)

( * ) Notice: Subject to any disclaimer, the term of this patent is extended or adjusted under 35 U.S.C. 154(b) by 0 days.

(21) Appl. No.: 14/106,891

(22) Filed: Dec. 16, 2013

(65) Prior Publication Data

US 2014/0179591 A1 Jun. 26, 2014

(30) Foreign Application Priority Data

Dec. 20, 2012 (EP) ..... 12198601

(51) Int. Cl.

| | |
|---|---|
| ***C11D 3/04*** | (2006.01) |
| ***C11D 3/12*** | (2006.01) |
| ***C11D 17/00*** | (2006.01) |
| ***C11D 3/20*** | (2006.01) |
| ***C11D 3/32*** | (2006.01) |
| ***C11D 3/37*** | (2006.01) |
| ***C11D 3/06*** | (2006.01) |
| ***C11D 3/30*** | (2006.01) |
| ***C11D 17/04*** | (2006.01) |

(52) U.S. Cl.

CPC *C11D 3/046* (2013.01); *C11D 3/06* (2013.01); *C11D 3/2079* (2013.01); *C11D 3/2086* (2013.01); *C11D 3/30* (2013.01); *C11D 3/32* (2013.01); *C11D 3/3726* (2013.01); *C11D 17/003* (2013.01); *C11D 17/043* (2013.01)

(58) Field of Classification Search

CPC ..... C11D 3/046; C11D 3/2079

USPC ..... 510/535, 353

See application file for complete search history.

(56) References Cited

U.S. PATENT DOCUMENTS

| | | | | |
|---|---|---|---|---|
| 5,916,967 | A * | 6/1999 | Jones | A61K 8/731 510/405 |
| 8,222,197 | B2 * | 7/2012 | Fernandez Prieto | C07C 237/22 510/303 |
| 8,236,748 | B2 * | 8/2012 | Fernandez Prieto | C07C 237/22 510/501 |
| 2008/0057005 | A1 | 3/2008 | Lehn et al. | |
| 2008/0087293 | A1 * | 4/2008 | Glenn | A45D 19/0008 132/210 |
| 2009/0124533 | A1 | 5/2009 | Kottke et al. | |
| 2011/0166291 | A1 | 7/2011 | Turk et al. | |
| 2011/0220537 | A1 * | 9/2011 | Fernandez-Prieto | C07C 237/22 206/524.7 |
| 2011/0223125 | A1 * | 9/2011 | Hough | A61K 8/8152 424/70.12 |
| 2011/0224124 | A1 * | 9/2011 | Fernandez Prieto | C07C 237/22 510/405 |
| 2011/0243873 | A1 * | 10/2011 | Hough | A61K 8/91 424/70.16 |
| 2011/0256085 | A1 * | 10/2011 | Talingting Pabalan | A61K 8/042 424/70.13 |
| 2013/0029894 | A1 * | 1/2013 | Bettiol | C11D 3/1266 510/236 |
| 2014/0179591 | A1 * | 6/2014 | Fernandez Prieto | C11D 3/06 510/535 |

OTHER PUBLICATIONS

EP Search Report, EP 12198601, dated May 16, 2013, containing 6 pages.

Suzuki M et al: "New 1-valine-based hydrogelators:formation of supramolecular hydrogels", Tetrahedron Letters, Elsevier, Amsterdam, NL, vol. 45, No. 28, Jul. 5, 2004 pp. 5399-5402, XP004518889, ISSN: 0040-4039, DOI:10.1016/J.TETLET.2044.05.056* p. 5400, left-hand col., line 16—right-hand col., line 33*.

* cited by examiner

*Primary Examiner* — Nicole M Buie-Hatcher
*Assistant Examiner* — M. Reza Asdjodi
(74) *Attorney, Agent, or Firm* — Gregory S. Darley-Emerson; Leonard W Lewis; Steve W Miller

(57) ABSTRACT

The structuring ability of fluid compositions comprising an amido-gellant or HEUR polymeric structurant can be improved with the addition of a cosmotrope.

14 Claims, 1 Drawing Sheet

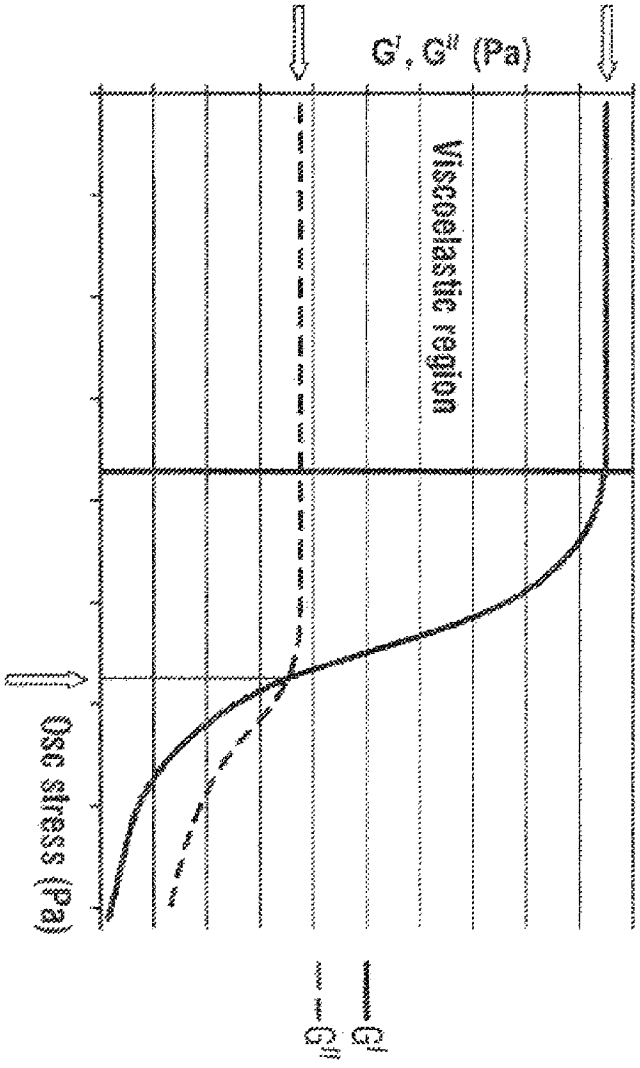
G', G'' (Pa)
Viscoelastic region
Osc stress (Pa)
G'
G''

STRUCTURING USING AN EXTERNAL STRUCTURANT AND A COSMOTROPE

FIELD OF THE INVENTION

The present invention relates to the structuring of fluid compositions using a combination of an external structurant and a cosmotrope.

BACKGROUND OF THE INVENTION

External structurants, useful for providing rheological benefits to fluid compositions, include those derived from polymers (both natural and synthetic), castor oil, fatty acids, fatty esters, or fatty soap water-insoluble waxes. However, the required performance ingredients often complicate the addition of external structurants known in the art and may even be incompatible with them. For instance, many external structurants are degraded by performance ingredients, such as enzymes. They are also often incompatible with low pH and peroxide bleaches. In addition, external structurants generally require the use of structurant premixes incorporating large amounts of water. Such structurant premixes are less suitable for compact detergents and for unit-dose applications.

Amido-gellants and hydrophobically modified ethoxylated urethane (HEUR) polymeric structurants provide structuring for fluid compositions, while also being compatible with a broad range of potential ingredients, such as bleaches and/or enzymes. They also provide an aesthetically pleasing pour profile without negatively impacting the composition clarity. Moreover, they can be formulated into structurant premixes that are low water, or even entirely water-free.

It is desirable to reduce the amount of such external structurants, while still providing the desired viscosity and level of structuring. Also, amido gellants and HEUR polymers can be difficult to mix into a fluid composition, particularly when high viscosities are desired.

Therefore, a need remains for a means of achieving the desired viscosity, and level of structuring, while using less of the external structurant, and also simplifying the process of mixing the external structurant into the fluid composition.

EP2365050 and EP2365052 disclose amido-gellants which are suitable for use in fluid compositions. EP2365051 and EP2365053 disclose fluid detergent compositions comprising amido gellants. WO 97/40133 discloses compositions comprising HEUR polymers.

SUMMARY OF THE INVENTION

The present invention relates to fluid compositions comprising: an external structurant selected from the group consisting of: an amido gellant, a hydrophobically modified ethoxylated urethane polymeric structurant, and mixtures thereof; and a cosmotrope selected from the group consisting of: calcium fluoride, calcium sulphate, calcium citrate, calcium formate, calcium hydrogenphosphate, calcium dihydrogenphosphate, tricalcium diphosphate, calcium acetate, sodium fluoride, sodium acetate, sodium phosphate, sodium hydrogenphosphate, sodium dihydrogenphosphate, potassium formate, tripotassium citrate, potassium chloride, potassium fluoride, potassium bromide, potassium acetate, potassium sulphate, monopotassium phosphate, dipotassium phosphate, tripotassium phosphate, ammonium chloride, ammonium fluoride, ammonium sulphate, ammonium phosphate, ammonium acetate (ammonium ethanoate), ammonium citrate, ammonium formate, tetramethylammonium chloride, tetramethylammonium acetate, tetramethylammonium bromide, tetramethylammonium fluoride, tetramethylammonium formate, tetramethylammonium sulphate, tetramethylammonium bisulphate, tetramethylammonium hydrogensulphate, tetramethylammonium citrate, tetramethylammonium phosphate, lithium fluoride, lithium chloride, trilithium citrate, lithium acetate, lithium phosphate, lithium formate, lithium sulphate, caesium fluoride, Caesium chloride, Caesium acetate, caesium phosphate, caesium citrate, caesium sulphate, rubidium acetate, rubidium chloride, rubidium fluoride, rubidium formate, rubidium sulphate, rubidium bromide, and mixtures thereof.

The present invention also relates to a process of forming such compositions, and the use of a cosmotrope for increasing the viscosity of a composition comprising an external structurant selected from the group consisting of: an amido gellant, a hydrophobically modified ethoxylated urethane polymeric structurant, and mixtures thereof.

It has been discovered that the fluid compositions of the present invention provide increased viscosity and structuring, even at lower levels of the external structurant. In addition, since the cosmotrope can be readily mixed into fluid compositions having a high viscosity, the compositions of the present invention can be more easily made, by first combining the external structurant with the fluid composition, and only increasing the viscosity after adding the cosmotrope.

BRIEF DESCRIPTION OF THE DRAWINGS

FIG. 1 details G' and G" within the linear viscoelastic region and the oscillation stress at the point where G' and G" cross over as a measure for gel strength.

DETAILED DESCRIPTION OF THE INVENTION

Suitable fluid compositions include, but are not limited to, consumer products such as: products for treating fabrics, such as for laundry detergent compositions, as well as for laundry and rinse additives; products for treating hard surfaces in the area of home care, including dishwashing compositions, floor cleaning compositions, and toilet bowl cleaning compositions; and personal care compositions such as shampoos, skin cleaners and exfolients, shaving liquids (including foams and gels), and oral care (including toothpastes, gels and whitening compositions).

A particularly preferred embodiment of the invention is a "fluid detergent composition". As used herein, "fluid detergent composition" refers to any composition comprising a fluid capable of wetting and cleaning a substrate, such as fabric. Suitable fluid detergent compositions include "fluid laundry detergent compositions". As used herein, "fluid laundry detergent composition" refers to any laundry treatment composition comprising a fluid capable of wetting and cleaning fabric e.g., clothing, in a domestic washing machine.

The fluid composition can include solids or gases in suitably subdivided form, but the overall composition excludes product forms which are non-fluid overall, such as tablets or granules. The fluid compositions preferably have densities in the range from of 0.9 to 1.3 grams per cubic centimeter, more preferably from 1.00 to 1.10 grams per cubic centimeter, excluding any solid additives but including any bubbles, if present.

The fluid composition may be dilute or concentrated liquids. Preferably, the fluid composition comprises from 1% to 95% by weight of water and/or non-aminofunctional solvent. For concentrated fluid compositions, the composition preferably comprises from 15% to 70%, more preferably from 20% to 50%, most preferably from 25% to 45% by weight of water and/or non-aminofunctional solvent. Alternatively, the fluid composition may be almost entirely non-aqueous, and comprise a non-aminofunctional solvent. Such fluid compositions may contain very little water. Such non-aqueous fluid compositions preferably comprise less than 15%, more preferably less than 10%, even more preferably less than 7% by weight of water. Most preferably, non-aqueous liquid compositions comprise no intentionally added water, beyond that added as part of another ingredient.

As used herein, "non-aminofunctional solvent" refers to any organic solvent, of use in the fluid composition, which contains no amino functional groups. Preferred non-aminofunctional solvents are liquid at ambient temperature and pressure (i.e. 21° C. and 1 atmosphere), and comprise carbon, hydrogen and oxygen. More preferred non-aminofunctional solvents include monohydric alcohols, dihydric alcohols, polyhydric alcohols, glycerol, glycols, polyalkylene glycols such as polyethylene glycol, and mixtures thereof. Mixtures of solvents are highly preferred, especially mixtures of two or more of the following: lower aliphatic alcohols such as ethanol, propanol, butanol, isopropanol; diols such as 1,2-propanediol or 1,3-propanediol; and glycerol.

All percentages, ratios and proportions used herein are by weight percent of the composition, unless otherwise specified. All average values are calculated "by weight" of the composition or components thereof, unless otherwise expressly indicated.

External Structurant:

The external structurant preferably imparts a shear thinning viscosity profile to the fluid composition, independently from, or extrinsic from, structuring effects of any surfactants of the composition. Preferred external structurants include those which provide a pouring viscosity from 50 cps to 20,000 cps, more preferably from 200 cps to 10,000 cps, most preferably from 500 cps to 7,000 cps. The fluid composition preferably has a resting viscosity of at least 1,500 cps, preferably at least 10,000 cps, more preferably at least 50,000 cps. This resting (low stress) viscosity represents the viscosity of the fluid composition under gentle shaking in the package and during transportation. Alternatively, the fluid composition may be a thixotropic gel. Such compositions may have a resting viscosity of from 10,000 cps to 500,000 cps, preferably from 100,000 cps to 400,000 cps, more preferably from 200,000 to 300,000. The preferred shear-thinning characteristics of the fluid detergent is defined as a ratio of low stress viscosity to pouring viscosity of at least 2, preferably at least 10, more preferably at least 100, up to 2000. The pouring viscosity is measured at a shear rate of 20 $sec^{-1}$, which is a shear rate that the fluid composition is typically exposed to during pouring. The resting (low stress) viscosity is determined under a constant stress of 0.1 Pa during a viscosity creep experiment over a 5 minute interval. Rheology measurements over the 5 minute interval are made after the composition has rested at zero shear rate for at least 10 minutes, between loading the sample in the rheometer and running the test. The data over the last 3 minutes are used to fit a straight line, and from the slope of this line, the low stress viscosity is calculated. The viscosity is measured at 21° C. using a TA AR 2000 (or AR G2) rheometer with a 40 mm stainless steel cone having an angle of 1°.

The external structurant is selected from the group consisting of: an amido gellant, a hydrophobically modified ethoxylated urethane (HEUR) polymeric structurant, and mixtures thereof.

The fluid composition preferably comprises the external structurant at a level of from 0.01 wt % to 10 wt %, more preferably from 0.05 wt % to 5 wt %, even more preferably from 0.075 wt % to 2 wt %, most preferably from 0.1 wt % to 0.5 wt % of the fluid composition.

1. Amido-Gellants:

Amido gellants, of use in the present invention, preferably comprise at least two nitrogen atoms, wherein at least two of said nitrogen atoms form amido functional groups. The amido gellant preferably has the following formula:

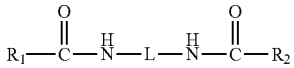

[I]

wherein: $R_1$ and $R_2$ are aminofunctional end-groups which may be the same or different and L is a linking moiety of molecular weight from 14 to 500 g/mol. An aminofunctional end-group is one that comprises a nitrogen atom. The linking moiety, L, can be any suitable group that connects the amido functional groups together. By suitably selecting the linking moiety, L, the separation of the amido functional groups can be adjusted.

Preferably, the amido gellant has a molecular weight from 150 to 1500 g/mol, more preferably from 300 g/mol to 900 g/mol, most preferably from 400 g/mol to 700 g/mol.

In a preferred embodiment: $R_1$ is $R_3$ or

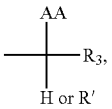

and $R_2$ is $R_4$ or

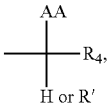

wherein AA is selected from the group consisting of:

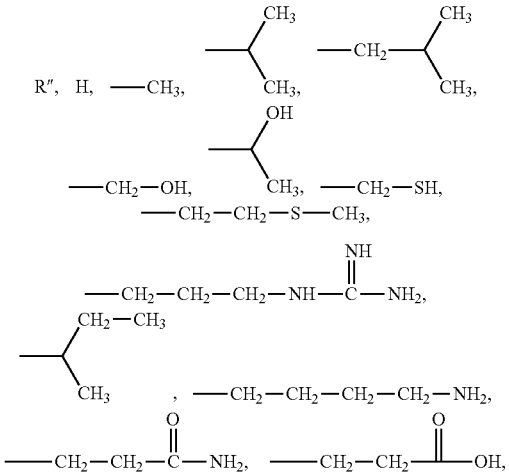

-continued

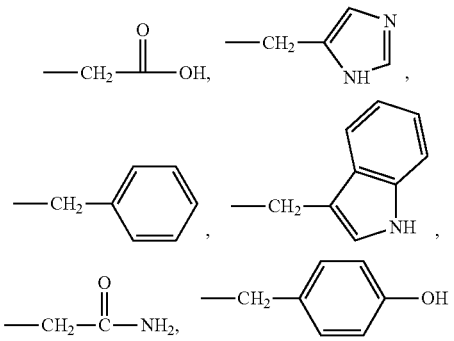

and $R_3$ and $R_4$ independently have the formula:

$$(L')_m\text{-}(L'')_q\text{—R, where } (m+q) \text{ is from 1 to 10.} \quad [II]$$

However, for $R_1$, the combination of AA, R', and $R_3$ must be selected such that $R_1$ is an aminofunctional end-group. Similarly, for $R_2$, the combination of AA, R', and $R_4$ must be selected such that $R_2$ is an aminofunctional end-group.

Preferably, L has the formula:

$$A_a\text{-}B_b\text{—}C_c\text{-}D_d\text{, where } (a+b+c+d) \text{ is from 1 to 20,} \quad [III]$$

wherein L', L" from formula [II] and A, B, C, D from formula [III] are independently selected from the group consisting of:

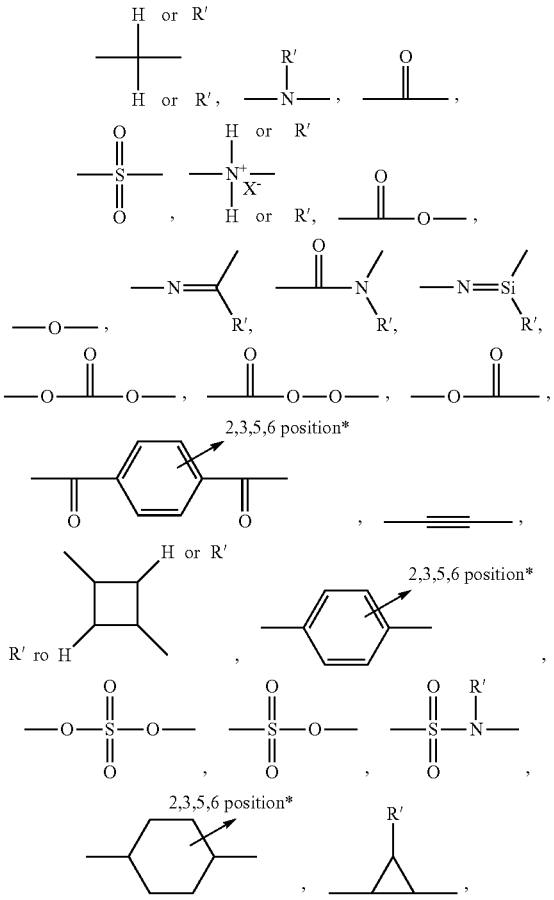

-continued

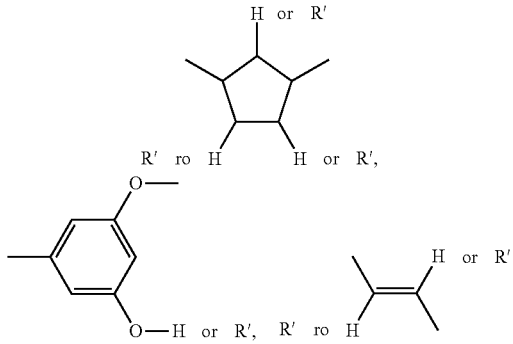

Preferably, L', L" from formula [II] and A, B, C, D from formula [III] are independently selected from the group consisting of:

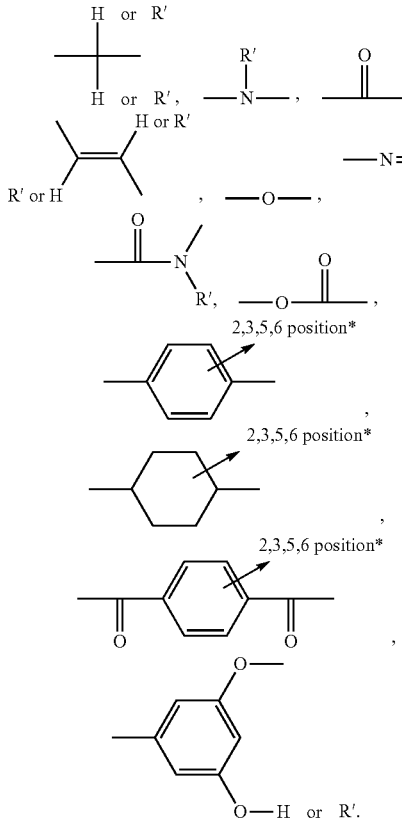

*the arrow indicates up to 4 substitutions in the positions indicated, and $X^-$ an anion and R, R' and R" are independently selected from AA and the group consisting of:

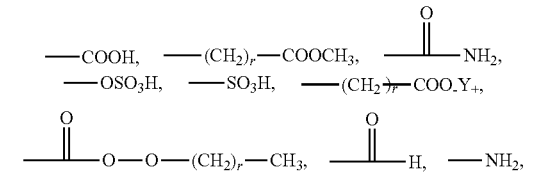

-continued
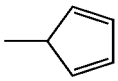
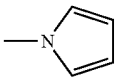
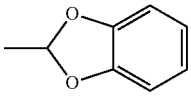
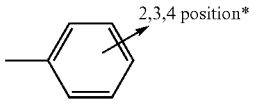
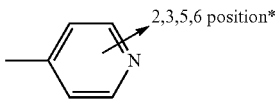
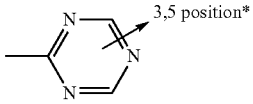
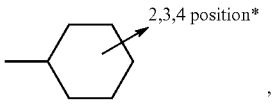
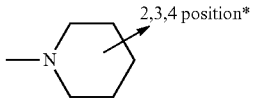
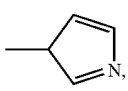
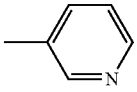
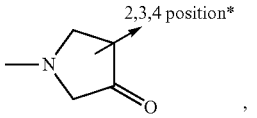
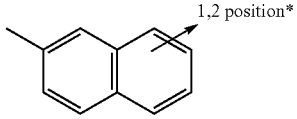
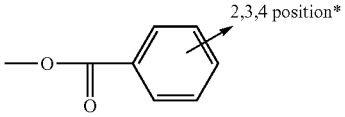
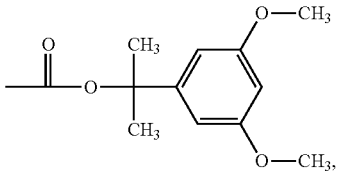
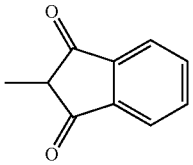
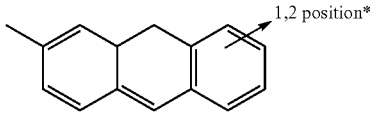
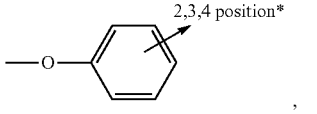
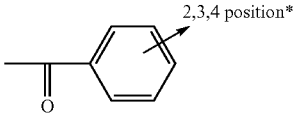
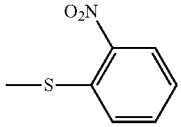
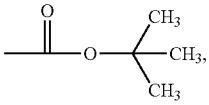
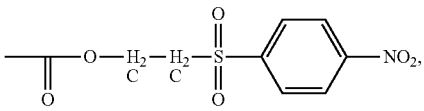
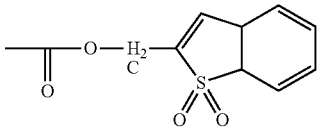
-continued
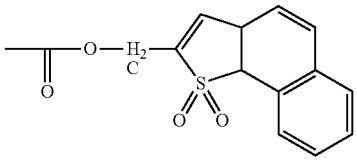
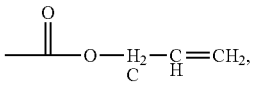
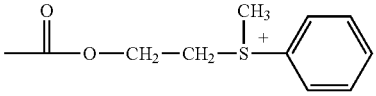
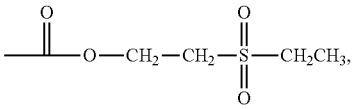
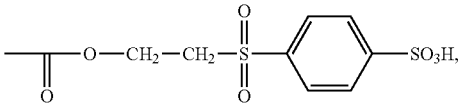
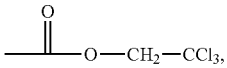
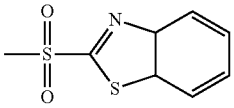
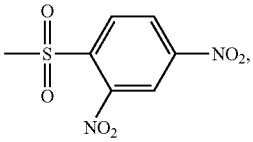
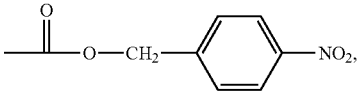
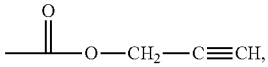
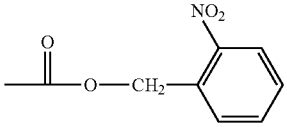
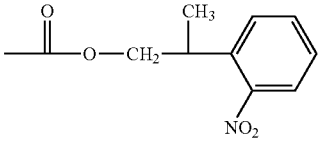
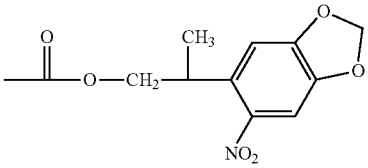
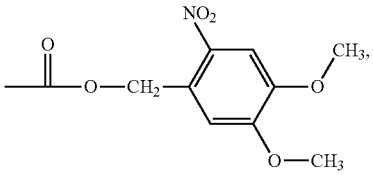
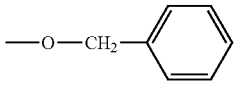
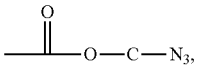

-continued

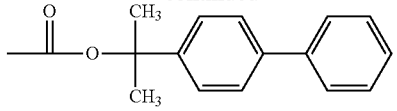

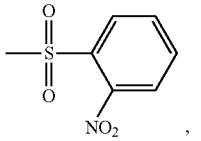

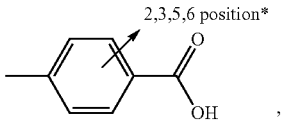

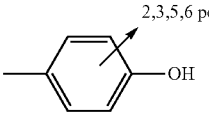

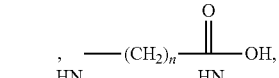

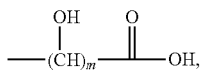

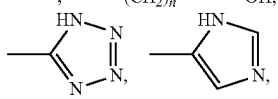

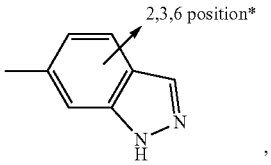

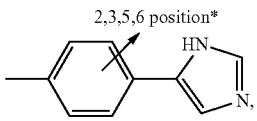

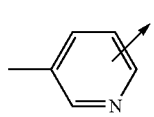

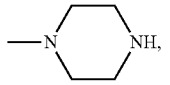

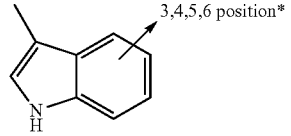

*the arrow indicates up to 4 substitutions in the positions indicated, r, m and n are integers from 1 to 20 and Y+ is a cation Preferably, R, R' and R" are independently selected from the group consisting of:

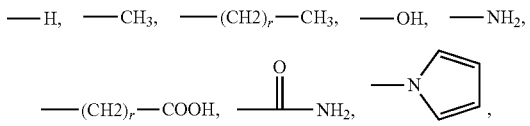

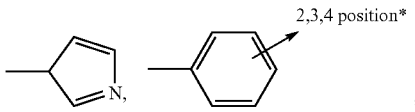

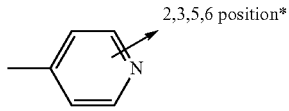

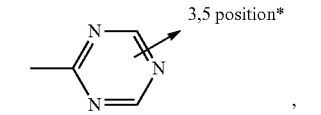

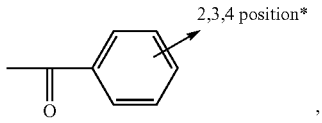

-continued

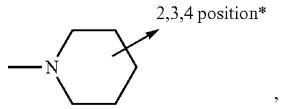

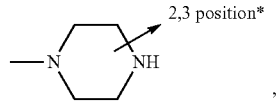

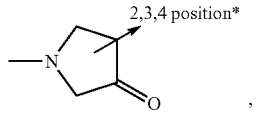

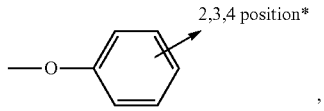

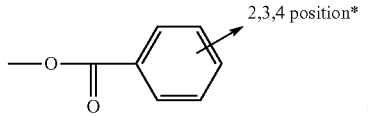

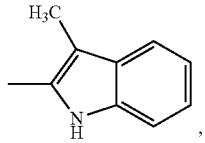

In a more preferred embodiment, the amido gellant is characterized in that:

L is an aliphatic linking group with a backbone chain of from 2 to 20 carbon atoms, preferably $—(CH_2)_n—$ wherein n is selected from 2 to 20. Preferably, $R_1$ and $R_2$ both have the structure:

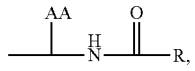

wherein: AA is selected from the group consisting of:

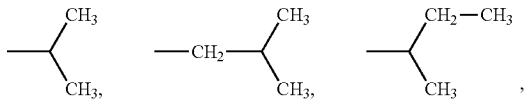

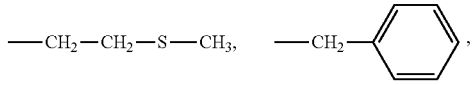

and R is selected from the group:

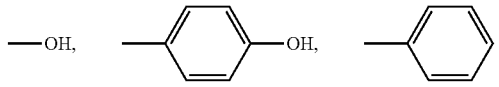

-continued

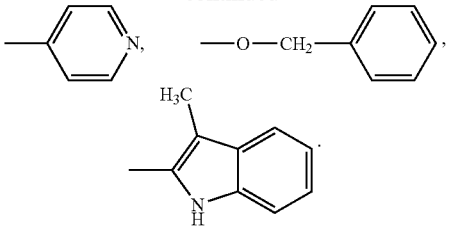

In another embodiment R, R' and R" can independently be selected from the group consisting of: an ethoxy group, an epoxy group with 1 to 15 ethoxy or epoxy units. In another embodiment, one or more of R, R' and R" may comprise a functional end group selected from the group consisting of: an aromatic, alicyclic, heteroaromatic, heterocyclic group including mono-, di-, and oligo-polysaccharides.

In another embodiment, two or more of L, L' and L" are the same group. The amido gellant molecule can be symmetric with respect to the L entity or can be asymmetric. Without intending to be bound by theory, it is believed that symmetric amido gellant molecules allow for more orderly structured networks to form, and are hence more efficient at sequestering water and providing structuring. In contrast, compositions comprising one or more asymmetric amido gellant molecules can create less ordered networks.

In one embodiment, the AA comprises at least one of: Alanine, β-Alanine and substituted Alanines; Linear Amino-Alkyl Carboxylic Acid; Cyclic Amino-Alkyl Carboxylic Acid; Aminobenzoic Acid Derivatives; Aminobutyric Acid Derivatives; Arginine and Homologues; Asparagine; Aspartic Acid; p-Benzoyl-Phenylalanine; Biphenylalanine; Citrulline; Cyclopropylalanine; Cyclopentylalanine; Cyclohexylalanine; Cysteine, Cystine and Derivatives; Diaminobutyric Acid Derivatives; Diaminopropionic Acid; Glutamic Acid Derivatives; Glutamine; Glycine; Substituted Glycines; Histidine; Homoserine; Indole Derivatives; Isoleucine; Leucine and Derivatives; Lysine; Methionine; Naphthylalanine; Norleucine; Norvaline; Ornithine; Phenylalanine; Ring-Substituted Phenylalanines; Phenylglycine; Pipecolic Acid, Nipecotic Acid and Isonipecotic Acid; Proline; Hydroxyproline; Thiazolidine; Pyridylalanine; Serine; Statine and Analogues; Threonine; Tetrahydronorharman-3-carboxylic Acid; 1,2,3, 4-Tetrahydroisoquinoline; Tryptophane; Tyrosine; Valine; and combinations thereof.

In one embodiment, the amido gellant comprises a pH tuneable group, to result in a pH-tuneable amido gellant. A pH tunable amido gellant can provide the fluid composition with a viscosity profile that changes with the pH of the composition. Hence, a pH tunable amido gellant can be added to a fluid composition at a pH at which the viscosity is sufficiently low to allow easy mixing, before changing the pH such that the pH tunable amido gellant provides structuring.

The pH tunable amido gellants comprise at least one pH sensitive group, that is either protonated or deprotonated by a change in composition pH. When a pH tunable amido gellant is added to a fluid composition comprising water, it is believed that the uncharged form of the amido gellant builds viscosity while the charged form is more soluble and less efficient at forming a viscosity building network. By increasing or decreasing the pH (depending on the selection of the pH-sensitive groups) the amido gellant is either protonated or deprotonated. Thus, by changing the pH of the solution, the solubility, and hence the viscosity building behaviour, of the amido gellant can be controlled. By careful selection of the pH-sensitive groups, the pKa of the amido gellant can be tailored. Hence, the choice of the pH-sensitive groups can be used to select the pH at which the amido gellant builds viscosity.

In one embodiment, L, $R_1$, $R_2$, and mixtures thereof, may comprise the pH tuneable group. In a preferred embodiment, $R_1$ and $R_2$ comprise the pH-tuneable group. In another embodiment R, R' and R" are amino functional end-groups, preferably amido functional end-group, more preferably pH-tuneable amido functional groups. In a preferred embodiment, the pH tuneable group comprises at least one pyridine group. Preferably, amido gellant comprises a pH tuneable group, such that the amido gellant has a pKa of from 0 to 30, more preferably from 1.5 to 14, even more preferably from 3 to 9, even more preferably from 4 to 8.

The amido-gellants can also be used for improving the structuring of the fluid composition and for suspending ingredients such as particulates in the fluid composition. Preferably, the fluid composition comprising the amido-gellant has a resting viscosity (see Test Methods) of at least 1,000 cps, more preferably at least 10,000 cps, most preferably at least 50,000 cps. This resting (low stress) viscosity represents the viscosity of the fluid composition under gentle shaking, such as during transportation.

To provide more robust structuring, the fluid detergent may comprise a mixture of two or more amido gellants. Such a mixture may include an amido gellant which has a higher solubility in water, with an amido gellant with higher solubility in non-aminofunctional solvents. Without intending to be bound by theory, it is believed that combining an amido gellant that is more soluble in water with an amido gellant that is more soluble in non-aminofunctional solvents provides improved structuring and stability to the formula. A preferred combination is: N,N'-(2S,2'S)-1,1'-(dodecane-1,12-diylbis(azanediyl))bis(3-methyl-1-oxobutane-2,1-diyl)diisonicotinamide with the more water-soluble N,N'-(2S,2'S)-1,1'-(propane-1,3-diylbis(azanediyl))bis(3-methyl-1-oxobutane-2,1-diyl)diisonicotinamide.

The amido gellant molecules may also comprise protective groups, preferably from 1 to 2 protective groups, most preferably two protective groups. Examples of suitable protective groups are provided in "Protecting Groups", P. J. Kocienski, ISBN 313 135601 4, Georg Thieme Verlag, Stuttgart; and "Protective Groups in Organic Chemistry", T. W. Greene, P. G. M. Wuts, ISBN 0-471-62301-6, John Wiley & Sons, Inc, New York.

The amido gellant preferably has a minimum gelling concentration (MGC) of from 0.1 to 100 mg/mL in the fluid composition, preferably from 0.1 to 25 mg/mL, more preferred from 0.5 to 10 mg/mL in accordance with the MGC Test Method. The MGC as used herein can be represented as mg/ml or as a wt %, where wt % is calculated as the MGC in mg/ml divided by 10. In one embodiment, when measured in the fluid composition, the MGC is from 0.1 to 100 mg/mL, preferably from 0.1 to 25 mg/mL of said amido gellant, more preferably from 0.5 to 10 mg/mL, or at least 0.1 mg/mL, at least 0.3 mg/mL, at least 0.5 mg/mL, at least 1.0 mg/mL, at least 2.0 mg/mL, at least 5.0 mg/mL of amido gellant. While the invention includes fluid compositions having an amido gellant concentration either above or below the MGC, the amido gellants of the invention result in particularly useful rheologies below the MGC.

Suitable amido gellants, and mixtures thereof, may be selected from table 1:

TABLE 1

Non-limiting examples of amido gellants of use in fluid compositions of the present invention:

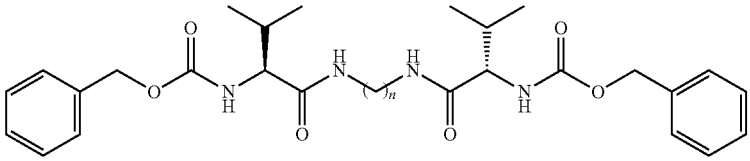

dibenzyl (2S,2'S)-1,1'-(ethane-1,2-diylbis(azanediyl))bis(3-methyl-1-oxobutane-2,1-diyl)dicarbamate
dibenzyl (2S,2'S)-1,1'-(butane-1,4-diylbis(azanediyl))bis(3-methyl-1-oxobutane-2,1-diyl)dicarbamate
dibenzyl (2S,2'S)-1,1'-(hexane-1,6-diylbis(azanediyl))bis(3-methyl-1-oxobutane-2,1-diyl)dicarbamate
dibenzyl (2S,2'S)-1,1'-(octane-1,8-diylbis(azanediyl))bis(3-methyl-1-oxobutane-2,1-diyl)dicarbamate
dibenzyl (2S,2'S)-1,1'-(decane-1,10-diylbis(azanediyl))bis(3-methyl-1-oxobutane-2,1-diyl)dicarbamate
dibenzyl (2S,2'S)-1,1'-(dodecane-1,12-diylbis(azanediyl))bis(3-methyl-1-oxobutane-2,1-diyl)dicarbamate
dibenzyl (2S,2'S)-1,1'-(hexadecane-1,16-diylbis(azanediyl))bis(3-methyl-1-oxobutane-2,1-diyl)dicarbamate
dibenzyl (2S,2'S)-1,1'-(tetradecane-1,14-diylbis(azanediyl))bis(3-methyl-1-oxobutane-2,1-diyl)dicarbamate
dibenzyl (2S,2'S)-1,1'-(propane-1,3-diylbis(azanediyl))bis(3-methyl-1-oxobutane-2,1-diyl)dicarbamate
dibenzyl (2S,2'S)-1,1'-(pentane-1,5-diylbis(azanediyl))bis(3-methyl-1-oxobutane-2,1-diyl)dicarbamate
dibenzyl (2S,2'S)-1,1'-(heptane-1,7-diylbis(azanediyl))bis(3-methyl-1-oxobutane-2,1-diyl)dicarbamate
dibenzyl (2S,2'S)-1,1'-(nonane-1,9-diylbis(azanediyl))bis(3-methyl-1-oxobutane-2,1-diyl)dicarbamate
dibenzyl (2S,2'S)-1,1'-(undecane-1,11-diylbis(azanediyl))bis(3-methyl-1-oxobutane-2,1-diyl)dicarbamate
dibenzyl (2S,2'S)-1,1'-(tridecane-1,13-diylbis(azanediyl))bis(3-methyl-1-oxobutane-2,1-diyl)dicarbamate
dibenzyl (2S,2'S)-1,1'-(octodecane-1,18-diylbis(azanediyl))bis(3-methyl-1-oxobutane-2,1-diyl)dicarbamate

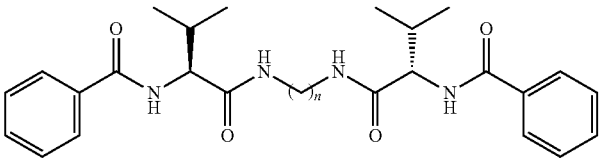

N,N'-(2S,2'S)-1,1'-(ethane-1,2-diylbis(azanediyl))bis(3-methyl-1-oxobutane-2,1-diyl)dibenzamide
N,N'-(2S,2'S)-1,1'-(propane-1,3-diylbis(azanediyl))bis(3-methyl-1-oxobutane-2,1-diyl)dibenzamide
N,N'-(2S,2'S)-1,1'-(pentane-1,5-diylbis(azanediyl))bis(3-methyl-1-oxobutane-2,1-diyl)dibenzamide
N,N'-(2S,2'S)-1,1'-(heptane-1,7-diylbis(azanediyl))bis(3-methyl-1-oxobutane-2,1-diyl)dibenzamide
N,N'-(2S,2'S)-1,1'-(nonane-1,9-diylbis(azanediyl))bis(3-methyl-1-oxobutane-2,1-diyl)dibenzamide TABLE 1-continued

| Non-limiting examples of amido gellants of use in fluid compositions of the present invention: |
|---|
| N,N'-(2S,2'S)-1,1'-(undecane-1,11-diylbis(azanediyl))bis(3-methyl-1-oxobutane-2,1-diyl)dibenzamide |
| N,N'-(2S,2'S)-1,1'-(tridecane-1,13-diylbis(azanediyl))bis(3-methyl-1-oxobutane-2,1-diyl)dibenzamide |
| N,N'-(2S,2'S)-1,1'-(octadecane-1,18-diylbis(azanediyl))bis(3-methyl-1-oxobutane-2,1-diyl)dibenzamide |
| N,N'-(2S,2'S)-1,1'-(butane-1,4-diylbis(azanediyl))bis(3-methyl-1-oxobutane-2,1-diyl)dibenzamide |
| N,N'-(2S,2'S)-1,1'-(hexane-1,6-diylbis(azanediyl))bis(3-methyl-1-oxobutane-2,1-diyl)dibenzamide |
| N,N'-(2S,2'S)-1,1'-(octane-1,8-diylbis(azanediyl))bis(3-methyl-1-oxobutane-2,1-diyl)dibenzamide |
| -(2S,2'S)-1,1'-(decane-1,10-diylbis(azanediyl))bis(3-methyl-1-oxobutane-2,1-diyl)dibenzamide |
| N,N'-(2S,2'S)-1,1'-(dodecane-1,12-diylbis(azanediyl))bis(3-methyl-1-oxobutane-2,1-diyl)dibenzamide |
| N,N'-(2S,2'S)-1,1'-(hexadecane-1,16-diylbis(azanediyl))bis(3-methyl-1-oxobutane-2,1-diyl)dibenzamide |
| N,N'-(2S,2'S)-1,1'-(tetradecane-1,14-diylbis(azanediyl))bis(3-methyl-1-oxobutane-2,1-diyl)dibenzamide |

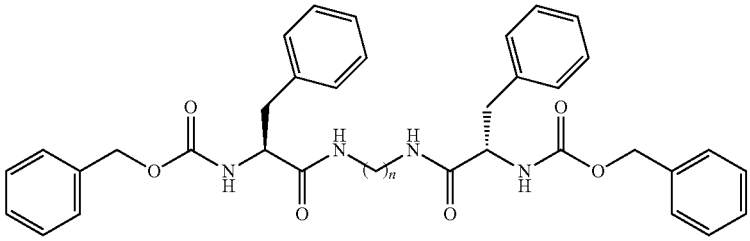

| |
|---|
| dibenzyl (2S,2'S)-1,1'-(propane-1,3-diylbis(azanediyl))bis(1-oxo-3-phenylpropane-2,1-diyl)dicarbamate |
| dibenzyl (2S,2'S)-1,1'-(pentane-1,5-diylbis(azanediyl))bis(1-oxo-3-phenylpropane-2,1-diyl)dicarbamate |
| dibenzyl (2S,2'S)-1,1'-(heptane-1,7-diylbis(azanediyl))bis(1-oxo-3-phenylpropane-2,1-diyl)dicarbamate |
| dibenzyl (2S,2'S)-1,1'-(decane-1,10-diylbis(azanediyl))bis(1-oxo-3-phenylpropane-2,1-diyl)dicarbamate |
| dibenzyl (2S,2'S)-1,1'-(dodecane-1,12-diylbis(azanediyl))bis(1-oxo-3-phenylpropane-2,1-diyl)dicarbamate |
| dibenzyl (2S,2'S)-1,1'-(hexadecane-1,16-diylbis(azanediyl))bis(1-oxo-3-phenylpropane-2,1-diyl)dicarbamate |
| dibenzyl (2S,2'S)-1,1'-(tetradecane-1,14-diylbis(azanediyl))bis(1-oxo-3-phenylpropane-2,1-diyl)dicarbamate |
| dibenzyl (2S,2'S)-1,1'-(ethane-1,2-diylbis(azanediyl))bis(1-oxo-3-phenylpropane-2,1-diyl)dicarbamate |
| dibenzyl (2S,2'S)-1,1'-(butane-1,4-diylbis(azanediyl))bis(1-oxo-3-phenylpropane-2,1-diyl)dicarbamate |
| dibenzyl (2S,2'S)-1,1'-(hexane-1,6-diylbis(azanediyl))bis(1-oxo-3-phenylpropane-2,1-diyl)dicarbamate |
| dibenzyl (2S,2'S)-1,1'-(nonane-1,9-diylbis(azanediyl))bis(1-oxo-3-phenylpropane-2,1-diyl)dicarbamate |

TABLE 1-continued

| Non-limiting examples of amido gellants of use in fluid compositions of the present invention: |
|---|
| dibenzyl (2S,2'S)-1,1'-(undecane-1,11-diylbis(azanediyl))bis(1-oxo-3-phenylpropane-2,1-diyl)dicarbamate<br>dibenzyl (2S,2'S)-1,1'-(tridecane-1,13-diylbis(azanediyl))bis(1-oxo-3-phenylpropane-2,1-diyl)dicarbamate<br>dibenzyl (2S,2'S)-1,1'-(octadecane-1,18-diylbis(azanediyl))bis(1-oxo-3-phenylpropane-2,1-diyl)dicarbamate |
| 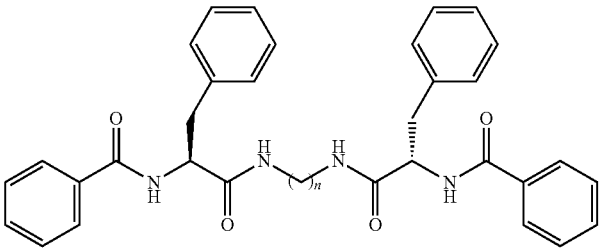 |
| N,N'-(2S,2'S)-1,1'-(ethane-1,2-diylbis(azanediyl))bis(1-oxo-3-phenylpropane-2,1-diyl)dibenzamide<br>N,N'-(2S,2'S)-1,1'-(butane-1,4-diylbis(azanediyl))bis(1-oxo-3-phenylpropane-2,1-diyl)dibenzamide<br>N,N'-(2S,2'S)-1,1'-(hexane-1,6-diylbis(azanediyl))bis(1-oxo-3-phenylpropane-2,1-diyl)dibenzamide<br>N,N'-(2S,2'S)-1,1'-(octane-1,8-diylbis(azanediyl))bis(1-oxo-3-phenylpropane-2,1-diyl)dibenzamide<br>N,N'-(2S,2'S)-1,1'-(decane-1,10-diylbis(azanediyl))bis(1-oxo-3-phenylpropane-2,1-diyl)dibenzamide<br>N,N'-(2S,2'S)-1,1'-(dodecane-1,12-diylbis(azanediyl))bis(1-oxo-3-phenylpropane-2,1-diyl)dibenzamide<br>N,N'-(2S,2'S)-1,1'-(tetradecane-1,14-diylbis(azanediyl))bis(1-oxo-3-phenylpropane-2,1-diyl)dibenzamide<br>N,N'-(2S,2'S)-1,1'-(octadecane-1,18-diylbis(azanediyl))bis(1-oxo-3-phenylpropane-2,1-diyl)dibenzamide<br>N,N'-(2S,2'S)-1,1'-(propane-1,3-diylbis(azanediyl))bis(1-oxo-3-phenylpropane-2,1-diyl)dibenzamide<br>N,N'-(2S,2'S)-1,1'-(pentane-1,5-diylbis(azanediyl))bis(1-oxo-3-phenylpropane-2,1-diyl)dibenzamide<br>N,N'-(2S,2'S)-1,1'-(heptane-1,7-diylbis(azanediyl))bis(1-oxo-3-phenylpropane-2,1-diyl)dibenzamide<br>N,N'-(2S,2'S)-1,1'-(nonane-1,9-diylbis(azanediyl))bis(1-oxo-3-phenylpropane-2,1-diyl)dibenzamide<br>N,N'-(2S,2'S)-1,1'-(undecane-1,11-diylbis(azanediyl))bis(1-oxo-3-phenylpropane-2,1-diyl)dibenzamide<br>N,N'-(2S,2'S)-1,1'-(tridecane-1,13-diylbis(azanediyl))bis(1-oxo-3-phenylpropane-2,1-diyl)dibenzamide<br>N,N'-(2S,2'S)-1,1'-(hexadecane-1,16-diylbis(azanediyl))bis(1-oxo-3-phenylpropane-2,1-diyl)dibenzamide |
| 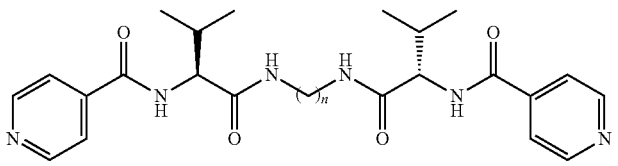 |

TABLE 1-continued

| Non-limiting examples of amido gellants of use in fluid compositions of the present invention: |
|---|
| N,N'-(2S,2'S)-1,1'-(ethane-1,2-diylbis(azanediyl))bis(3-methyl-1-oxobutane-2,1-diyl)diisonicotinamide |
| N,N'-(2S,2'S)-1,1'-(butane-1,4-diylbis(azanediyl))bis(3-methyl-1-oxobutane-2,1-diyl)diisonicotinamide |
| N,N'-(2S,2'S)-1,1'-(hexane-1,6-diylbis(azanediyl))bis(3-methyl-1-oxobutane-2,1-diyl)diisonicotinamide |
| N,N'-(2S,2'S)-1,1'-(octane-1,8-diylbis(azanediyl))bis(3-methyl-1-oxobutane-2,1-diyl)diisonicotinamide |
| N,N'-(2S,2'S)-1,1'-(decane-1,10-diylbis(azanediyl))bis(3-methyl-1-oxobutane-2,1-diyl)diisonicotinamide |
| N,N'-(2S,2'S)-1,1'-(dodecane-1,12-diylbis(azanediyl))bis(3-methyl-1-oxobutane-2,1-diyl)diisonicotinamide |
| N,N'-(2S,2'S)-1,1'-(tetradecane-1,14-diylbis(azanediyl))bis(3-methyl-1-oxobutane-2,1-diyl)diisonicotinamide |
| N,N'-(2S,2'S)-1,1'-(octadecane-1,18-diylbis(azanediyl))bis(3-methyl-1-oxobutane-2,1-diyl)diisonicotinamide |
| N,N'-(2S,2'S)-1,1'-(propane-1,3-diylbis(azanediyl))bis(3-methyl-1-oxobutane-2,1-diyl)diisonicotinamide |
| N,N'-(2S,2'S)-1,1'-(pentane-1,5-diylbis(azanediyl))bis(3-methyl-1-oxobutane-2,1-diyl)diisonicotinamide |
| N,N'-(2S,2'S)-1,1'-(heptane-1,7-diylbis(azanediyl))bis(3-methyl-1-oxobutane-2,1-diyl)diisonicotinamide |
| N,N'-(2S,2'S)-1,1'-(nonane-1,9-diylbis(azanediyl))bis(3-methyl-1-oxobutane-2,1-diyl)diisonicotinamide |
| N,N'-(2S,2'S)-1,1'-(undecane-1,11-diylbis(azanediyl))bis(3-methyl-1-oxobutane-2,1-diyl)diisonicotinamide |
| N,N'-(2S,2'S)-1,1'-(tridecane-1,13-diylbis(azanediyl))bis(3-methyl-1-oxobutane-2,1-diyl)diisonicotinamide |
| N,N'-(2S,2'S)-1,1'-(hexadecane-1,16-diylbis(azanediyl))bis(3-methyl-1-oxobutane-2,1-diyl)diisonicotinamide |
| 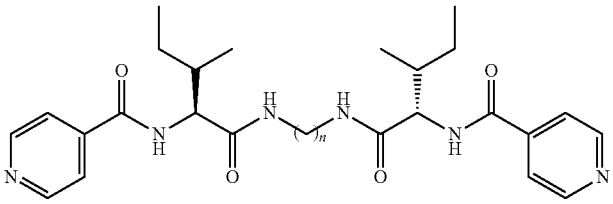 |
| N-[(1S)-2-methyl-1-[2-[[(2S)-3-methyl-2-(pyridine-4-carbonylamino)pentanoyl]amino]ethylcarbamoyl]butyl]pyridine-4-carboxamide |
| N-[(1S)-2-methyl-1-[4-[[(2S)-3-methyl-2-(pyridine-4-carbonylamino)pentanoyl]amino]butylcarbamoyl]butyl]pyridine-4-carboxamide |
| N-[(1S)-2-methyl-1-[6-[[(2S)-3-methyl-2-(pyridine-4-carbonylamino)pentanoyl]amino]hexylcarbamoyl]butyl]pyridine-4-carboxamide |
| N-[(1S)-2-methyl-1-[8-[[(2S)-3-methyl-2-(pyridine-4-carbonylamino)pentanoyl]amino]octylcarbamoyl]butyl]pyridine-4-carboxamide |
| N-[(1S)-2-methyl-1-[10-[[(2S)-3-methyl-2-(pyridine-4-carbonylamino)pentanoyl]amino]decylcarbamoyl]butyl]pyridine-4-carboxamide |

TABLE 1-continued

| Non-limiting examples of amido gellants of use in fluid compositions of the present invention: |
|---|
| N-[(1S)-2-methyl-1-[12-[[(2S)-3-methyl-2-(pyridine-4-carbonylamino)pentanoyl]amino]dodecylcarbamoyl]butyl]pyridine-4-carboxamide |
| N-[(1S)-2-methyl-1-[3-[[(2S)-3-methyl-2-(pyridine-4-carbonylamino)pentanoyl]amino]propylcarbamoyl]butyl]pyridine-4-carboxamide |
| N-[(1S)-2-methyl-1-[5-[[(2S)-3-methyl-2-(pyridine-4-carbonylamino)pentanoyl]amino]pentylcarbamoyl]butyl]pyridine-4-carboxamide |
| N-[(1S)-2-methyl-1-[7-[[(2S)-3-methyl-2-(pyridine-4-carbonylamino)pentanoyl]amino]heptylcarbamoyl]butyl]pyridine-4-carboxamide |
| N-[(1S)-2-methyl-1-[9-[[(2S)-3-methyl-2-(pyridine-4-carbonylamino)pentanoyl]amino]nonylcarbamoyl]butyl]pyridine-4-carboxamide |
| N-[(1S)-2-methyl-1-[11-[[(2S)-3-methyl-2-(pyridine-4-carbonylamino)pentanoyl]amino]undecylcarbamoyl]butyl]pyridine-4-carboxamide |
| 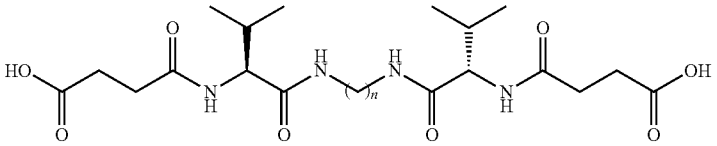 |
| (6S,13S)-6,13-diisopropyl-4,7,12,15-tetraoxo-5,8,11,14-tetraazaoctadecane-1,18-dioic acid |
| (6S,15S)-6,15-diisopropyl-4,7,14,17-tetraoxo-5,8,13,16-tetraazaeicosane-1,20-dioic acid |
| (6S,17S)-6,17-diisopropyl-4,7,16,19-tetraoxo-5,8,15,18-tetraazadocosane-1,22-dioic acid |
| (6S,19S)-6,19-diisopropyl-4,7,18,21-tetraoxo-5,8,17,20-tetraazatetracosane-1,24-dioic acid |
| (6S,21S)-6,21-diisopropyl-4,7,20,23-tetraoxo-5,8,19,22-tetraazahexacosane-1,26-dioic acid |
| (6S,23S)-6,23-diisopropyl-4,7,22,25-tetraoxo-5,8,21,24-tetraazaoctacosane-1,28-dioic acid |
| (6S,14S')-6,14-diisopropyl-4,7,13,16-tetraoxo-5,8,12,15-tetraazanonadecane-1,19-dioic acid |
| (6S,16S)-6,16-diisopropyl-4,7,15,18-tetraoxo-5,8,14,17-tetraazaheneicosane-1,21-dioic acid |
| (6S,18S)-6,18-diisopropyl-4,7,17,20-tetraoxo-5,8,16,19-tetraazatricosane-1,23-dioic acid |
| (6S,20S)-6,20-diisopropyl-4,7,19,22-tetraoxo-5,8,18,21-tetraazapentacosane-1,25-dioic acid |
| (6S,22S)-6,22-diisopropyl-4,7,21,24-tetraoxo-5,8,20,23-tetraazaheptacosane-1,27-dioic acid |
| 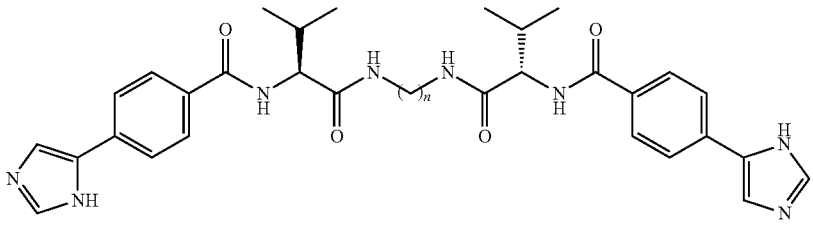 |
| N,N'-(2S,2'S)-1,1'-(ethane-1,2-diylbis(azanediyl))bis(3-methyl-1-oxobutane-2,1-diyl)bis(4-(1H-imidazol-5-yl)benzamide) |
| N,N'-(2S,2'S)-1,1'-(butane-1,4-diylbis(azanediyl))bis(3-methyl-1-oxobutane-2,1-diyl)bis(4-(1H-imidazol-5-yl)benzamide) |
| N,N'-(2S,2'S)-1,1'-(hexane-1,6-diylbis(azanediyl))bis(3-methyl-1-oxobutane-2,1-diyl)bis(4-(1H-imidazol-5-yl)benzamide) |

TABLE 1-continued

| Non-limiting examples of amido gellants of use in fluid compositions of the present invention: |
|---|
| N,N'-(2S,2'S)-1,1'-(octane-1,8-diylbis(azanediyl))bis(3-methyl-1-oxobutane-2,1-diyl)bis(4-(1H-imidazol-5-yl)benzamide) |
| N,N'-(2S,2'S)-1,1'-(decane-1,10-diylbis(azanediyl))bis(3-methyl-1-oxobutane-2,1-diyl)bis(4-(1H-imidazol-5-yl)benzamide) |
| N,N'-(2S,2'S)-1,1'-(dodecane-1,12-diylbis(azanediyl))bis(3-methyl-1-oxobutane-2,1-diyl)bis(4-(1H-imidazol-5-yl)benzamide) |
| N,N'-(2S,2'S)-1,1'-(propane-1,3-diylbis(azanediyl))bis(3-methyl-1-oxobutane-2,1-diyl)bis(4-(1H-imidazol-5-yl)benzamide) |
| N,N'-(2S,2'S)-1,1'-(pentane-1,5-diylbis(azanediyl))bis(3-methyl-1-oxobutane-2,1-diyl)bis(4-(1H-imidazol-5-yl)benzamide) |
| N,N'-(2S,2'S)-1,1'-(heptane-1,7-diylbis(azanediyl))bis(3-methyl-1-oxobutane-2,1-diyl)bis(4-(1H-imidazol-5-yl)benzamide) |
| N,N'-(2S,2'S)-1,1'-(nonane-1,9-diylbis(azanediyl))bis(3-methyl-1-oxobutane-2,1-diyl)bis(4-(1H-imidazol-5-yl)benzamide) |
| N,N'-(2S,2'S)-1,1'-(undecane-1,11-diylbis(azanediyl))bis(3-methyl-1-oxobutane-2,1-diyl)bis(4-(1H-imidazol-5-yl)benzamide) |
| 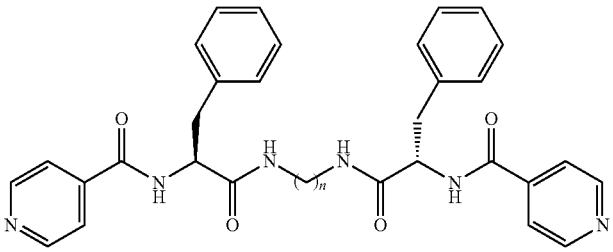 |
| N,N'-(2S,2'S)-1,1'-(ethane-1,2-diylbis(azanediyl))bis(1-oxo-3-phenylpropane-2,1-diyl)diisonicotinamide |
| N,N'-(2S,2'S)-1,1'-(butane-1,4-diylbis(azanediyl))bis(1-oxo-3-phenylpropane-2,1-diyl)diisonicotinamide |
| N,N'-(2S,2'S)-1,1'-(hexane-1,6-diylbis(azanediyl))bis(1-oxo-3-phenylpropane-2,1-diyl)diisonicotinamide |
| N,N'-(2S,2'S)-1,1'-(octane-1,8-diylbis(azanediyl))bis(1-oxo-3-phenylpropane-2,1-diyl)diisonicotinamide |
| N,N'-(2S,2'S)-1,1'-(decane-1,10-diylbis(azanediyl))bis(1-oxo-3-phenylpropane-2,1-diyl)diisonicotinamide |
| N,N'-(2S,2'S)-1,1'-(dodecane-1,12-diylbis(azanediyl))bis(1-oxo-3-phenylpropane-2,1-diyl)diisonicotinamide |
| N,N'-(2S,2'S)-1,1'-(tetradecane-1,14-diylbis(azanediyl))bis(1-oxo-3-phenylpropane-2,1-diyl)diisonicotinamide |
| N,N'-(2S,2'S)-1,1'-(octadecane-1,18-diylbis(azanediyl))bis(1-oxo-3-phenylpropane-2,1-diyl)diisonicotinamide |
| N,N'-(2S,2'S)-1,1'-(propane-1,3-diylbis(azanediyl))bis(1-oxo-3-phenylpropane-2,1-diyl)diisonicotinamide |
| N,N'-(2S,2'S)-1,1'-(pentane-1,5-diylbis(azanediyl))bis(1-oxo-3-phenylpropane-2,1-diyl)diisonicotinamide |
| N,N'-(2S,2'S)-1,1'-(heptane-1,7-diylbis(azanediyl))bis(1-oxo-3-phenylpropane-2,1-diyl)diisonicotinamide |
| N,N'-(2S,2'S)-1,1'-(nonane-1,9-diylbis(azanediyl))bis(1-oxo-3-phenylpropane-2,1-diyl)diisonicotinamide |
| N,N'-(2S,2'S)-1,1'-(undecane-1,11-diylbis(azanediyl))bis(1-oxo-3-phenylpropane-2,1-diyl)diisonicotinamide |

TABLE 1-continued

| Non-limiting examples of amido gellants of use in fluid compositions of the present invention: |
|---|
| N,N'-(2S,2'S)-1,1'-(tridecane-1,13-diylbis(azanediyl))bis(1-oxo-3-phenylpropane-2,1-diyl)diisonicotinamide<br>N,N'-(2S,2'S)-1,1'-(hexadecane-1,16-diylbis(azanediyl))bis(1-oxo-3-phenylpropane-2,1-diyl)diisonicotinamide |
| 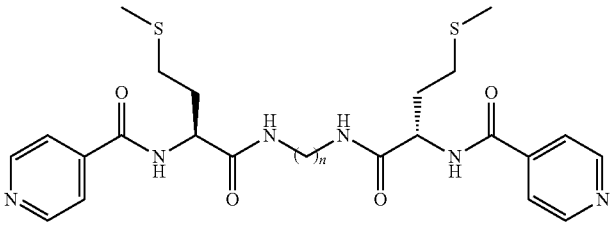 |
| N-[(1S)-3-methylsulfanyl-1-[2-[[(2S)-4-methylsulfanyl-2-(pyridine-4-carbonylamino)butanoyl]amino]ethylcarbamoyl]propyl]pyridine-4-carboxamide<br>N-[(1S)-3-methylsulfanyl-1-[4-[[(2S)-4-methylsulfanyl-2-(pyridine-4-carbonylamino)butanoyl]amino]butylcarbamoyl]propyl]pyridine-4-carboxamide<br>N-[(1S)-3-methylsulfanyl-1-[6-[[(2S)-4-methylsulfanyl-2-(pyridine-4-carbonylamino)butanoyl]amino]hexylcarbamoyl]propyl]pyridine-4-carboxamide<br>N-[(1S)-3-methylsulfanyl-1-[8-[[(2S)-4-methylsulfanyl-2-(pyridine-4-carbonylamino)butanoyl]amino]octylcarbamoyl]propyl]pyridine-4-carboxamide<br>N-[(1S)-3-methylsulfanyl-1-[10-[[(2S)-4-methylsulfanyl-2-(pyridine-4-carbonylamino)butanoyl]amino]decylcarbamoyl]propyl]pyridine-4-carboxamide<br>N-[(1S)-3-methylsulfanyl-1-[12-[[(2S)-4-methylsulfanyl-2-(pyridine-4-carbonylamino)butanoyl]amino]dodecylcarbamoyl]propyl]pyridine-4-carboxamide<br>N-[(1S)-3-methylsulfanyl-1-[3-[[(2S)-4-methylsulfanyl-2-(pyridine-4-carbonylamino)butanoyl]amino]propylcarbamoyl]propyl]pyridine-4-carboxamide<br>N-[(1S)-3-methylsulfanyl-1-[5-[[(2S)-4-methylsulfanyl-2-(pyridine-4-carbonylamino)butanoyl]amino]pentylcarbamoyl]propyl]pyridine-4-carboxamide<br>N-[(1S)-3-methylsulfanyl-1-[7-[[(2S)-4-methylsulfanyl-2-(pyridine-4-carbonylamino)butanoyl]amino]heptylcarbamoyl]propyl]pyridine-4-carboxamide<br>N-[(1S)-3-methylsulfanyl-1-[9-[[(2S)-4-methylsulfanyl-2-(pyridine-4-carbonylamino)butanoyl]amino]nonylcarbamoyl]propyl]pyridine-4-carboxamide<br>N-[(1S)-3-methylsulfanyl-1-[11-[[(2S)-4-methylsulfanyl-2-(pyridine-4-carbonylamino)butanoyl]amino]undecylcarbamoyl]propyl]pyridine-4-carboxamide |

The more preferred amido gellants are selected from the group consisting of: N,N'-(2S,2'S)-1,1'-(ethane-1,2-diylbis(azanediyl))bis(3-methyl-1-oxobutane-2,1-diyl)diisonicotinamide, N,N'-(2S,2'S)-1,1'-(propane-1,3-diylbis(azanediyl))bis(3-methyl-1-oxobutane-2,1-diyl)diisonicotinamide, N,N'-(2S,2'S)-1,1'-(butane-1,4-diylbis(azanediyl))bis(3-methyl-1-oxobutane-2,1-diyl)diisonicotinamide, N,N'-(2S,2'S)-1,1'-(pentane-1,5-diylbis(azanediyl))bis(3-methyl-1-oxobutane-2,1-diyl)diisonicotinamide, N,N'-(2S,2'S)-1,1'-(hexane-1,6-diylbis(azanediyl))bis(3-methyl-1-oxobutane-2,1-diyl) diisonicotinamide, N,N'-(2S,2'S)-1,1'-(heptane-1,7-diylbis(azanediyl))bis(3-methyl-1-oxobutane-2,1-diyl) diisonicotinamide, N,N'-(2S,2'S)-1,1'-(octane-1,8-diylbis(azanediyl))bis(3-methyl-1-oxobutane-2,1-diyl) diisonicotinamide, N,N'-(2S,2'S)-1,1'-(nonane-1,9-diylbis(azanediyl))bis(3-methyl-1-oxobutane-2,1-diyl) diisonicotinamide, N,N'-(2S,2'S)-1,1'-(decane-1,10-diylbis(azanediyl))bis(3-methyl-1-oxobutane-2,1-diyl) diisonicotinamide, N,N'-(2S,2'S)-1,1'-(undecane-1,11-diylbis(azanediyl))bis(3-methyl-1-oxobutane-2,1-diyl) diisonicotinamide, N,N'-(2S,2'S)-1,1'-(dodecane-1,12-diylbis(azanediyl))bis(3-methyl-1-oxobutane-2,1-diyl) diisonicotinamide, N,N'-(2S,2'S)-1,1'-(tridecane-1,13-diylbis(azanediyl))bis(3-methyl-1-oxobutane-2,1-diyl)

diisonicotinamide, N,N'-(2S,2'S)-1,1'-(tetradecane-1,14-diylbis(azanediyl))bis(3-methyl-1-oxobutane-2,1-diyl) diisonicotinamide, N,N'-(2S,2'S)-1,1'-(hexadecane-1,16-diylbis(azanediyl))bis(3-methyl-1-oxobutane-2,1-diyl) diisonicotinamide, N,N'-(2S,2'S)-1,1'-(octadecane-1,18-diylbis(azanediyl))bis(3-methyl-1-oxobutane-2,1-diyl) diisonicotinamide, N-[(1S)-2-methyl-1-[2-[[2S)-3-methyl-2-(pyridine-4-carbonylamino)pentanoyl]amino] ethylcarbamoyl]butyl]pyridine-4-carboxamide, N-[(1S)-2-methyl-1-[4-[[(2S)-3-methyl-2-(pyridine-4-carbonylamino) pentanoyl]amino]butylcarbamoyl]butyl]pyridine-4-carboxamide, N-[(1S)-2-methyl-1-[6-[[(2S)-3-methyl-2-(pyridine-4-carbonylamino)pentanoyl]amino] hexylcarbamoyl]butyl]pyridine-4-carboxamide, N-[(1S)-2-methyl-1-[8-[[(2S)-3-methyl-2-(pyridine-4-carbonylamino) pentanoyl]amino]octylcarbamoyl]butyl]pyridine-4-carboxamide, N-[(1S)-2-methyl-1-[10-[[(2S)-3-methyl-2-(pyridine-4-carbonylamino)pentanoyl]amino] decylcarbamoyl]butyl]pyridine-4-carboxamide, N-[(1S)-2-methyl-1-[12-[[(2S)-3-methyl-2-(pyridine-4-carbonylamino)pentanoyl]amino]dodecylcarbamoyl]butyl] pyridine-4-carboxamide, N-[(1S)-2-methyl-1-[3-[[(2S)-3-methyl-2-(pyridine-4-carbonylamino)pentanoyl]amino] propylcarbamoyl]butyl]pyridine-4-carboxamide, N-[(1S)-2-methyl-1-[5-[[(2S)-3-methyl-2-(pyridine-4-carbonylamino) pentanoyl]amino]pentylcarbamoyl]butyl]pyridine-4-carboxamide, N-[(1S)-2-methyl-1-[7-[[(2S)-3-methyl-2-(pyridine-4-carbonylamino)pentanoyl]amino] heptylcarbamoyl]butyl]pyridine-4-carboxamide, N-[(1S)-2-methyl-1-[9-[[(2S)-3-methyl-2-(pyridine-4-carbonylamino) pentanoyl]amino]nonylcarbamoyl]butyl]pyridine-4-carboxamide, N-[(1S)-2-methyl-1-[11-[[(2S)-3-methyl-2-(pyridine-4-carbonylamino)pentanoyl]amino] undecylcarbamoyl]butyl]pyridine-4-carboxamide, N-[(1S)-3-methylsulfanyl-1-[2-[[(2S)-4-methylsulfanyl-2-(pyridine-4-carbonylamino)butanoyl]amino]ethylcarbamoyl]propyl] pyridine-4-carboxamide, N-[(1S)-3-methylsulfanyl-1-[3-[[(2S)-4-methylsulfanyl-2-(pyridine-4-carbonylamino) butanoyl]amino]propylcarbamoyl]propyl]pyridine-4-carboxamide, N-[(1S)-3-methylsulfanyl-1-[4-[[(2S)-4-methylsulfanyl-2-(pyridine-4-carbonylamino)butanoyl] amino]butylcarbamoyl]propyl]pyridine-4-carboxamide, N-[(1S)-3-methylsulfanyl-1-[5-[[(2S)-4-methylsulfanyl-2-(pyridine-4-carbonylamino)butanoyl]amino]pentylcarbamoyl]propyl]pyridine-4-carboxamide, N-[(1S)-3-methylsulfanyl-1-[6-[[(2S)-4-methylsulfanyl-2-(pyridine-4-carbonylamino)butanoyl]amino]hexylcarbamoyl]propyl] pyridine-4-carboxamide, N-[(1S)-3-methylsulfanyl-1-[7-[[(2S)-4-methylsulfanyl-2-(pyridine-4-carbonylamino) butanoyl]amino]heptylcarbamoyl]propyl]pyridine-4-carboxamide, N-[(1S)-3-methylsulfanyl-1-[8-[[(2S)-4-methylsulfanyl-2-(pyridine-4-carbonylamino)butanoyl] amino]octylcarbamoyl]propyl]pyridine-4-carboxamide, N-[(1S)-3-methylsulfanyl-1-[9-[[(2S)-4-methylsulfanyl-2-(pyridine-4-carbonylamino)butanoyl]amino]nonylcarbamoyl]propyl]pyridine-4-carboxamide, N-[(1S)-3-methylsulfanyl-1-[10-[[(2S)-4-methylsulfanyl-2-(pyridine-4-carbonylamino)butanoyl]amino]decylcarbamoyl]propyl] pyridine-4-carboxamide, N-[(1S)-3-methylsulfanyl-1-[11-[[(2S)-4-methylsulfanyl-2-(pyridine-4-carbonylamino) butanoyl]amino]undecylcarbamoyl]propyl]pyridine-4-carboxamide, N-[(1S)-3-methylsulfanyl-1-[12-[[(2S)-4-methylsulfanyl-2-(pyridine-4-carbonylamino)butanoyl]amino] dodecylcarbamoyl]propyl]pyridine-4-carboxamide, dibenzyl (2S,2'S)-1,1'-(ethane-1,2-diylbis(azanediyl))bis(3-methyl-1-oxobutane-2,1-diyl)dicarbamate, dibenzyl (2S,2'S)-1,1'-(butane-1,4-diylbis(azanediyl))bis(3-methyl-1-oxobutane-2,1-diyl)dicarbamate, dibenzyl (2S,2'S)-1,1'-(hexane-1,6-diylbis(azanediyl))bis(3-methyl-1-oxobutane-2,1-diyl)dicarbamate, dibenzyl (2S,2'S)-1,1'-(octane-1,8-diylbis(azanediyl))bis(3-methyl-1-oxobutane-2,1-diyl) dicarbamate, dibenzyl (2S,2'S)-1,1'-(decane-1,10-diylbis (azanediyl))bis(3-methyl-1-oxobutane-2,1-diyl) dicarbamate, dibenzyl (2S,2'S)-1,1'-(dodecane-1,12-diylbis (azanediyl))bis(3-methyl-1-oxobutane-2,1-diyl) dicarbamate, dibenzyl (2S,2'S)-1,1'-(propane-1,3-diylbis (azanediyl))bis(3-methyl-1-oxobutane-2,1-diyl) dicarbamate, dibenzyl (2S,2'S)-1,1'-(pentane-1,5-diylbis (azanediyl))bis(3-methyl-1-oxobutane-2,1-diyl) dicarbamate, dibenzyl (2S,2'S)-1,1'-(heptane-1,7-diylbis (azanediyl))bis(3-methyl-1-oxobutane-2,1-diyl) dicarbamate, dibenzyl (2S,2'S)-1,1'-(nonane-1,9-diylbis (azanediyl))bis(3-methyl-1-oxobutane-2,1-diyl) dicarbamate, dibenzyl (2S,2'S)-1,1'-(undecane-1,11-diylbis (azanediyl))bis(3-methyl-1-oxobutane-2,1-diyl) dicarbamate, and mixtures thereof.

The most preferred amido gellants are selected from the group consisting of: N,N'-(2S,2'S)-1,1'-(propane-1,3-diylbis (azanediyl))bis(3-methyl-1-oxobutane-2,1-diyl)diisonicotinamide, N,N'-(2S,2'S)-1,1'-(dodecane-1,12-diylbis (azanediyl))bis(3-methyl-1-oxobutane-2,1-diyl) diisonicotinamide, N,N'-(2S,2'S)-1,1'-(tridecane-1,13-diylbis(azanediyl))bis(3-methyl-1-oxobutane-2,1-diyl) diisonicotinamide, N-[(1S)-2-methyl-1-[12-[[(2S)-3-methyl-2-(pyridine-4-carbonylamino)pentanoyl]amino] dodecylcarbamoyl]butyl]pyridine-4-carboxamide, N-[(1S)-2-methyl-1-[3-[[(2S)-3-methyl-2-(pyridine-4-carbonylamino)pentanoyl]amino]propylcarbamoyl]butyl] pyridine-4-carboxamide, N-[(1S)-3-methylsulfanyl-1-[3-[[(2S)-4-methylsulfanyl-2-(pyridine-4-carbonylamino) butanoyl]amino]propylcarbamoyl]propyl]pyridine-4-carboxamide, N-[(1S)-3-methylsulfanyl-1-[12-[[(2S)-4-methylsulfanyl-2-(pyridine-4-carbonylamino)butanoyl] amino]dodecylcarbamoyl]propyl]pyridine-4-carboxamide, dibenzyl (2S,2'S)-1,1'-(dodecane-1,12-diylbis(azanediyl)) bis(3-methyl-1-oxobutane-2,1-diyl)dicarbamate, dibenzyl (2S,2'S)-1,1'-(propane-1,3-diylbis(azanediyl))bis(3-methyl-1-oxobutane-2,1-diyl)dicarbamate, and mixtures thereof.

2. Hydrophobically-Modified Ethoxylated Urethanes (HEUR) Polymeric Structurants:

The fluid composition may comprise a hydrophobically-modified ethoxylated urethane (HEUR) polymeric structurant. HEUR polymeric structurants are water-soluble polymers, having hydrophobic end-groups, comprising blocks of ethylene glycol units, propylene glycol units, and mixtures thereof, in addition to urethane units.

Preferred HEUR polymeric structurants can have the following structure:

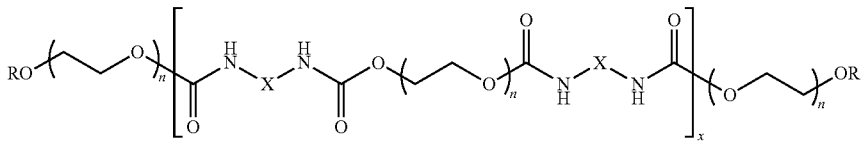

wherein:

R is an alkyl chain, preferably a C6-C24 alkyl chain, more preferably a C12-C18 alkyl chain, n is preferably from 25 to 400, preferably from 50 to 250, more preferably from 75 to 180, X can be any suitable linking group.

Suitable HEUR polymeric structurants can have a molecular weight of from 1,000 to 1,000,000, more preferably from 15,000 to 50,000 g/mol. An example of a suitable HEUR polymeric structurant is ACUSOL 880, sold by ROHM and HAAS.

Cosmotrope:

A cosmotrope is used in the compositions of the present invention, to improve the efficacy of an external structurant selected from the group consisting of: an amido gellant, a hydrophobically modified ethoxylated urethane polymeric structurant, and mixtures thereof.

Cosmotropes are salts which stabilize hydrophobic groups or molecules in aqueous solution and reduce the solubility of hydrophobic groups or molecules. Without wishing to be bound by theory, it is believed that the cosmotrope lowers the solubility of hydrophobic groups in the external structurant, including the aminofunctional end-groups of the amido-gellants, and the ethylene glycol or propylene glycol blocks of the HEUR polymer, thereby increasing the viscosity and structuring provided by the external structurant. By lowering the concentration at which the external structurant self assembles, the cosmotrope also lowers the concentration at which the external structurant provides viscosity and structuring.

In the context of the present invention, the cosmotrope is believed to strengthen the intermolecular interactions between amido groups of the amido gellants or of the HEUR polymeric structurants, and hence improve the ability of such amido gellants and HEUR structurants to self-assemble. Without wishing to be bound by theory, it is believed that the cosmotropes of the present invention, being ions with high surface charge, low polarizability and strong hydration, are able to partially "salt-out" the external structurant, and hence reduce its solubility. It is believed that this salting-out process reduces the concentration of the external structurant, at which gelation starts to occur.

The cosmotropes of the present invention may be selected from the group consisting of: calcium fluoride, calcium sulphate, calcium citrate, calcium formate, calcium hydrogenphosphate, calcium dihydrogenphosphate, tricalcium diphosphate, calcium acetate, sodium fluoride, sodium acetate, sodium phosphate, sodium hydrogenphosphate, sodium dihydrogenphosphate, potassium formate, tripotassium citrate, potassium chloride, potassium fluoride, potassium bromide, potassium acetate, potassium sulphate, monopotassium phosphate, dipotassium phosphate, tripotassium phosphate, ammonium chloride, ammonium fluoride, ammonium sulphate, ammonium phosphate, ammonium acetate (ammonium ethanoate), ammonium citrate, ammonium formate, tetramethylammonium chloride, tetramethylammonium acetate, tetramethylammonium bromide, tetramethylammonium fluoride, tetramethylammonium formate, tetramethylammonium sulphate, tetramethylammonium bisulphate, tetramethylammonium hydrogensulphate, tetramethylammonium citrate, tetramethylammonium phosphate, lithium fluoride, lithium chloride, trilithium citrate, lithium acetate, lithium phosphate, lithium formate, lithium sulphate, caesium fluoride, Caesium chloride, Caesium acetate, caesium phosphate, caesium citrate, caesium sulphate, rubidium acetate, rubidium chloride, rubidium fluoride, rubidium formate, rubidium sulphate, rubidium bromide, and mixtures thereof. Preferably, the cosmotrope is selected from the group consisting of: calcium fluoride, calcium sulphate, calcium citrate, calcium formate, calcium hydrogenphosphate, Calcium dihydrogenphosphate, tricalcium diphosphate, calcium acetate, sodium fluoride, sodium acetate, sodium phosphate, sodium hydrogenphosphate, sodium dihydrogenphosphate, potassium formate, tripotassium citrate, potassium chloride, potassium fluoride, potassium bromide, potassium acetate, potassium sulphate, monopotassium phosphate, dipotassium phosphate, tripotassium phosphate, ammonium chloride, ammonium fluoride, ammonium sulphate, ammonium phosphate, ammonium acetate (ammonium ethanoate), ammonium citrate, ammonium formate, tetramethylammonium chloride, tetramethylammonium acetate, tetramethylammonium bromide, tetramethylammonium fluoride, tetramethylammonium formate, tetramethylammonium sulphate, tetramethylammonium bisulphate, tetramethylammonium hydrogensulphate, tetramethylammonium citrate, tetramethylammonium phosphate, and mixtures thereof. Even more preferably, the cosmotrope is selected from the group consisting of: calcium fluoride, calcium sulphate, calcium citrate, calcium formate, calcium acetate, sodium fluoride, sodium acetate, potassium formate, tripotassium citrate, potassium chloride, potassium acetate, potassium sulphate, ammonium chloride, ammonium sulphate, acetate (ammonium ethanoate), ammonium citrate, ammonium formate, tetramethylammonium chloride, tetramethylammonium acetate, tetramethylammonium formate, tetramethylammonium sulphate, tetramethylammonium bisulphate, tetramethylammonium hydrogensulphate, tetramethylammonium citrate, and mixtures thereof.

The cosmotrope is preferably present at a level of from 0.1% to 10%, preferably from 0.2% to 5%, more preferably from 0.3% to 3% by weight of the fluid composition.

Adjunct Ingredients:

The fluid composition may also include ingredients selected from the group consisting of: anionic surfactant, nonionic surfactant, amphoteric surfactant, zwitterionic surfactant, cationic surfactant, enzymes, enzyme stabilizers; amphiphilic alkoxylated grease cleaning polymers; clay soil cleaning polymers; soil release polymers; soil suspending polymers; bleaching systems; optical brighteners; hueing dyes; particulate material; perfume and other odour control agents, including perfume delivery systems; hydrotropes; suds suppressors; fabric care benefit agents; pH adjusting agents; dye transfer inhibiting agents; preservatives; non-fabric substantive dyes; and mixtures thereof.

In a preferred embodiment, the fluid composition comprises a surfactant. Such fluid detergent compositions of the present invention typically comprise from 1% to 70%, preferably from 5% to 60% by weight, more preferably from 10% to 50%, and most preferably from 15% to 45% by weight of a surfactant. The surfactant is preferably selected from the group consisting of: anionic, nonionic surfactants and mixtures thereof. The preferred ratio of anionic to nonionic surfactant is from 100:0 (i.e. no nonionic surfactant) to 5:95, more preferably from 99:1 to 1:4, most preferably 5:1 to 1.5:1.

The fluid detergent compositions of the present invention preferably comprises from 1 to 50%, preferably from 5 to 40%, more preferably from 10 to 30% by weight of one or more anionic surfactants. Preferred anionic surfactant are selected from the group consisting of: C11-C18 alkyl benzene sulphonates, C10-C20 branched-chain and random alkyl sulphates, C10-C18 alkyl ethoxy sulphates, mid-chain branched alkyl sulphates, mid-chain branched alkyl alkoxy sulphates, C10-C18 alkyl alkoxy carboxylates comprising 1-5 ethoxy units, modified alkylbenzene sulphonate, C12-

C20 methyl ester sulphonate, C10-C18 alpha-olefin sulphonate, C6-C20 sulphosuccinates, and mixtures thereof. However, by nature, every anionic surfactant known in the art of detergent compositions may be used, such as those disclosed in "Surfactant Science Series", Vol. 7, edited by W. M. Linfield, Marcel Dekker. However, the compositions of the present invention comprise preferably at least one sulphonic acid surfactant, such as a linear alkyl benzene sulphonic acid, or the water-soluble salt forms.

Anionic sulphonate or sulphonic acid surfactants suitable for use herein include the acid and salt forms of linear or branched C5-C20, more preferably C10-C16, most preferably C11-C13 alkylbenzene sulphonates, C5-C20 alkyl ester sulphonates, C6-C22 primary or secondary alkane sulphonates, C5-C20 sulphonated polycarboxylic acids, and mixtures thereof. The aforementioned surfactants can vary widely in their 2-phenyl isomer content.

Anionic sulphate salts suitable for use in compositions of the invention include: primary and secondary alkyl sulphates, having a linear or branched alkyl or alkenyl moiety having from 9 to 22 carbon atoms, more preferably from 12 to 18 carbon atoms; beta-branched alkyl sulphate surfactants; and mixtures thereof.

Mid-chain branched alkyl sulphates or sulphonates are also suitable anionic surfactants for use in the compositions of the invention. Preferred are the C5-C22, preferably C10-C20 mid-chain branched alkyl primary sulphates. When mixtures are used, the average number of carbon atoms for the alkyl moieties is preferably within the range of from 14.5 to 17.5. Preferred mono-methyl-branched primary alkyl sulphates are selected from the group consisting of the 3-methyl to 13-methyl pentadecanol sulphates, the corresponding hexadecanol sulphates, and mixtures thereof. Dimethyl derivatives or other biodegradable alkyl sulphates having light branching can similarly be used.

Other suitable anionic surfactants for use herein include fatty methyl ester sulphonates and/or alkyl ethyoxy sulphates (AES) and/or alkyl polyalkoxylated carboxylates (AEC). Mixtures of anionic surfactants can be used, for example mixtures of alkylbenzenesulphonates and AES.

The anionic surfactants are typically present in the form of their salts with alkanolamines or alkali metals such as sodium and potassium. Preferably, the anionic surfactants are neutralized with alkanolamines such as monoethanolamine or triethanolamine, and are fully soluble in the liquid phase.

The fluid detergent compositions of the present invention preferably comprise up to 30%, preferably from 1 to 15%, more preferably from 2 to 10% by weight of one or more nonionic surfactants. Suitable nonionic surfactants include, but are not limited to C12-C18 alkyl ethoxylates ("AE") including the so-called narrow peaked alkyl ethoxylates, C6-C12 alkyl phenol alkoxylates (especially ethoxylates and mixed ethoxy/propoxy), block alkylene oxide condensate of C6-C12 alkyl phenols, alkylene oxide condensates of C8-C22 alkanols and ethylene oxide/propylene oxide block polymers (Pluronic®-BASF Corp.), as well as semi polar nonionics (e.g., amine oxides and phosphine oxides). An extensive disclosure of suitable nonionic surfactants can be found in U.S. Pat. No. 3,929,678.

Alkylpolysaccharides such as disclosed in U.S. Pat. No. 4,565,647 are also useful nonionic surfactants for compositions of the invention. Also suitable are alkyl polyglucoside surfactants. In some embodiments, suitable nonionic surfactants include those of the formula $R_1(OC_2H_4)_nOH$, wherein $R_1$ is a C10-C16 alkyl group or a C8-C12 alkyl phenyl group, and n is from 3 to about 80. In some embodiments, the nonionic surfactants may be condensation products of C12-C15 alcohols with from 5 to 20 moles of ethylene oxide per mole of alcohol, e.g., C12-C13 alcohol condensed with about 6.5 moles of ethylene oxide per mole of alcohol. Additional suitable nonionic surfactants include polyhydroxy fatty acid amides of the formula:

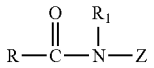

wherein R is a C9-C17 alkyl or alkenyl, $R_1$ is a methyl group and Z is glycidyl derived from a reduced sugar or alkoxylated derivative thereof. Examples are N-methyl N-1-deoxyglucityl cocoamide and N-methyl N-1-deoxyglucityl oleamide.

The fluid compositions of the present invention may comprise a detersive enzyme, which are typically used to provide improved cleaning performance and/or fabric care benefits. The detersive enzyme may be present in an amount of from 0.0001% to 8% by weight of the fluid composition. It has been found that the external structurants, of use in the present invention, are not degraded by enzyme action. Suitable enzymes can be selected from the group consisting of: lipase, protease, amylase, cellulase, pectate lyase, xyloglucanase, and mixtures thereof. A preferred enzyme combination comprises lipase, protease, cellulase, amylase, and mixtures thereof. The fluid composition preferably comprises a proteolytic enzyme, such as protease. Detersive enzymes are described in greater detail in U.S. Pat. No. 6,579,839.

The combination of external structurant and cosmotrope are particularly suited for suspending particulate material, in fluid compositions of the present invention. Suitable particulate material may be selected from the group consisting of: clays, suds suppressors, encapsulated sensitive ingredients, aesthetic adjuncts such as pearlescent agents including mica, pigment particles, or the like. Preferred particulate materials are encapsulated sensitive ingredients selected from the group consisting of: perfume microcapsules, encapsulated bleaches, encapsulated enzymes, and mixtures thereof. Perfume microcapsules are particularly preferred. Perfume microcapsules comprise a microcapsule core and a microcapsule wall that surrounds the microcapsule core. The core comprises a perfume. Perfume microcapsules, and methods of making them are disclosed in the following references: US 2003-215417 A1; US 2003-216488 A1; US 2003-158344 A1; US 2003-165692 A1; US 2004-071742 A1; US 2004-071746 A1; US 2004-072719 A1; US 2004-072720 A1; EP 1393706 A1; US 2003-203829 A1; US 2003-195133 A1; US 2004-087477 A1; US 2004-0106536 A1; U.S. Pat. No. 6,645,479; U.S. Pat. No. 6,200,949; U.S. Pat. No. 4,882,220; U.S. Pat. No. 4,917,920; U.S. Pat. No. 4,514,461; U.S. RE 32713; U.S. Pat. No. 4,234,627. Suitable levels of particulate materials are from 0.0001% to 5%, or from 0.1% to 1% by weight of the fluid detergent composition.

Water-Soluble Unit Dose Articles:

Since the external structurants and cosmotropes of the present invention are also effective at structuring fluid compositions that are low in water, they are particularly suitable as components of fluid compositions that are to be enclosed within a water soluble film, to form a water-soluble unit dose article.

It has also been found that fluid compositions, of the present invention, are able to sequester water and inhibit the water, present in the fluid composition, from interacting with the water soluble film. As such, fluid compositions comprising higher levels of water can be encapsulated into a water-soluble film to form unit-dose articles. Where the fluid composition comprises less than 30%, preferably less than 25%, more preferably less than 17% by weight of water, the fluid composition can be enclosed in a water-soluble or dispersible film, to form a water-soluble unit dose article, without dissolving the water soluble film. Fluid compositions of the present invention, which are non-aqueous fluid compositions, can also be enclosed within a water soluble film, to form a water-soluble unit dose article.

Suitable water soluble films comprise polymers, copolymers or derivatives thereof. Preferred polymers, copolymers or derivatives thereof are selected from the group consisting of: polyvinyl alcohols, polyvinyl pyrrolidone, polyalkylene oxides, acrylamide, acrylic acid, cellulose, cellulose ethers, cellulose esters, cellulose amides, polyvinyl acetates, polycarboxylic acids and salts, polyaminoacids or peptides, polyamides, polyacrylamide, copolymers of maleic/acrylic acids, polysaccharides including starch and gelatin, natural gums such as xanthum and carragum. More preferred polymers are selected from polyacrylates and water-soluble acrylate copolymers, methylcellulose, carboxymethylcellulose sodium, dextrin, ethylcellulose, hydroxyethyl cellulose, hydroxypropyl methylcellulose, maltodextrin, polymethacrylates, and most preferably selected from polyvinyl alcohols, polyvinyl alcohol derivatives or copolymers, hydroxypropyl methyl cellulose (HPMC), hydroxypropyl methyl cellulose derivatives or copolymers, and combinations thereof.

Process of Making a Fluid Detergent Composition Comprising the External Structurant and Cosmotrope:

The present invention also provides for a preferred process of making a fluid composition comprising the steps of: providing a fluid premix comprising a solvent selected from: water, non-aminofunctional solvent, and mixtures thereof; combining an external structurant selected from the group consisting of: an amido gellant, a hydrophobically modified ethoxylated urethane polymeric structurant, and mixtures thereof, with the fluid premix; and combining a cosmotrope with the fluid premix.

It is preferred that the cosmotrope is combined with the fluid premix, in a step after combining the external structurant with the fluid premix. Cosmotropes comprise small, readily dispersible ions, which can be easily distributed into the partially structured fluid premix, even as the viscosity increases. However, the cosmotrope can be combined with the fluid premix before the external structurant is added.

When making a fluid detergent composition, the fluid premix preferably comprises a surfactant selected from an anionic surfactant, nonionic surfactant, and mixtures thereof. The surfactant is typically combined into the premix before adding the external structurant. As such, the process may further comprise a step of adding a surfactant to the fluid premix before the external structurant is combined with the fluid premix.

The external structurant may be combined with the fluid premix, as part of a structurant premix. It has been found that such structurant premixes can be free or essentially free of water. For instance, in one embodiment, the structurant premix comprises a solvent, preferably an organic solvent, to solubilise the amido gellant. This is a substantial advantage when structuring fluid compositions that are either highly concentrated or comprise very little water. For instance, when making fluid compositions that are suitable for packaging into water-soluble unit dose articles. The structurant premix may also be free or essentially free of added electrolytes. Suitable organic solvents include those that are liquid at 21° C., and are preferably selected from the group consisting of: non-aminofunctional solvents, nonionic surfactants, anionic surfactants, and mixtures thereof. Non-aminofunctional solvents are most preferred.

The organic solvent is preferably selected from the group consisting of: an organic solvent, a nonionic surfactant, an anionic surfactant, or mixtures thereof.

In another embodiment, the process comprises the additional step of cooling the resultant fluid composition, before a further step of adding heat sensitive ingredients such as detersive enzymes, perfume microcapsules, and mixtures thereof. When cooling the fluid composition, the composition temperature is brought below the temperature at which the heat sensitive ingredients are subject to decomposition.

In another embodiment, the step of combining the structurant premix with the fluid premix is performed by adding the structurant premix at a temperature of at least 80° C., to the fluid premix, heated up to a temperature of not more than 60° C., preferably not more than 50° C. Heat-sensitive ingredients, such as those selected from the group consisting of: enzymes, perfumes, perfume microcapsules, bleach catalysts, photobleaches, bleaches, dyes, and mixtures thereof, are added to the resultant fluid composition after the structurant premix has been added, and after the composition has been cooled to below 45° C., preferably below 30° C. In such processes, the cosmotrope can be added before or after the resultant fluid composition has been cooled.

Where the fluid composition comprises less than 30%, preferably less than 25%, more preferably less than 17% by weight of water, the fluid composition can be enclosed in a water-soluble or dispersible film, to form a water-soluble unit dose article. Most preferably, in processes for making a unit-dose article, the fluid composition is a non-aqueous fluid composition.

Test Methods:

A) pH Measurement:

The pH is measured on the neat composition, at 25° C., using a Santarius PT-10P pH meter with gel-filled probe (such as the Toledo probe, part number 52 000 100), calibrated according to the instructions manual.

B) Minimum Gelling Concentration (MGC)

MGC is calculated by a tube inversion method based on R. G. Weiss, P. Terech; "Molecular Gels: Materials with self-assembled fibrillar structures" 2006 Springer, p 243. In order to determine the MGC, three screenings are done:

First Screening:

prepare several vials increasing the external structurant concentration from 0.5% to 5.0 weight % in 0.5% steps Determine in which interval the gel is formed (one inverted sample still flowing and the next one is already a strong gel). In case no gel is formed at 5%, higher concentrations are used.

Second Screening:

prepare several vials increasing the external structurant concentration in 0.1 weight % steps in the interval determined in the first screening.

Determine in which interval the gel is formed (one inverted sample still flowing and the next one is already a strong gel)

Third Screening:

in order to have a very precise percentage of the MGC, run a third screening in 0.025 weight % steps in the interval determined in the second screening.

The Minimum Gelling Concentration (MGC) is the lowest concentration which forms a gel in the third screening (does not flow on inversion of the sample).

For each screening, samples are prepared and treated as follows: 8 mL vials (borosilacate glass with Teflon cap, ref. B7857D, Fisher Scientific Bioblock) are filled with 2.0000±0.0005 g (KERN ALJ 120-4 analytical balance with ±0.1 mg precision) of the fluid (comprising the fluid composition and external structurant) for which we want to determine the MGC. The vial is sealed with the screw cap and left for 10 minutes in an ultrasound bath (Elma Transsonic T 710 DH, 40 kHz, 9.5 L, at 25° C. and operating at 100% power) in order to disperse the solid in the fluid. Complete dissolution is then achieved by heating, using a heating gun (Bosch PHG-2), and gentle mechanical stirring of the vials. It is crucial to observe a completely clear solution. Handle vials with care. While they are manufactured to resist high temperatures, a high solvent pressure may cause the vials to explode. Vials are cooled to 25° C., for 10 min in a thermostatic bath (Compatible Control Thermostats with controller CC2, D77656, Huber). Vials are inverted, left inverted for 1 minute, and then observed for which samples do not flow. After the third screening, the concentration of the sample that does not flow after this time is the MGC. For those skilled in the art, it is obvious that during heating solvent vapours may be formed, and upon cooling down the samples, these vapours can condense on top of the gel. When the vial is inverted, this condensed vapour will flow. This is discounted during the observation period. If no gels are obtained in the concentration interval, higher concentrations must be evaluated.

C) Gel Strength:

An AR-G2 rheometer from TA Instruments is used for rheological measurements.

Plate: 40 mm standard 1° steel cone plate.

The gel strength, as defined by the cross-over of the elastic modulus, G', and the viscous modulus, G", is measured using a stress sweep test whereby the oscillation stress is increased from 0.001 Pa to 10 Pa, taking 10 points per decade at 20° C. and at a frequency of 1 Hz. We use G' value within the linear viscoelastic region as a measure for the gel strength, as shown in FIG. 1.

EXAMPLES

The following fluid compositions were prepared according to the MGC test method, using N,N'-(2R,2'R)-1,1'-(propane-1,3-diylbis(azanediyl))bis(3-methyl-1-ox-obutane-2,1-diyl) diisonicotinamide as the external structurant:

| | Ex 1 Comparative | Ex 2 Of invention | Ex 3 Of invention | Ex 4 Comparative | Ex 5 Comparative |
|---|---|---|---|---|---|
| Salt | No salt | 0.8 wt % NaF[1] | 2 wt % NaF[1] | 2 wt % NaSCN[2] | 4 wt % NaSCN[2] |
| MGC (%) | 1.075 | 0.885 | 0.600 | 1.225 | 1.450 |

[1]Cosmotrope of use in compositions of the present invention
[2]Comparative salt The method of measuring the Minimum Gelling Concentration provides a measure of the minimum concentration of the external structurant at which gelling occurs. As can be seen by comparing Examples 2 and 3 with example 1 (no added salt), the cosmotrope reduces the concentration of the external structurant, at which the external structurant gels the fluid composition. In contrast, the addition of sodium thiocyanate (NaSCN) results in an increase in the minimum gelling concentration.

Liquid detergent compositions were prepared as follows:

Step 1: A structurant premix A was prepared by dissolving 1.4% N,N'-(2R,2'R)-1,1'-(dodecane-1,12-diylbis(azanediyl))bis(3-methyl-1-ox-obutane-2,1-diyl)diisonicotinamide in 9.8 grams of linear alkylbenzene sulphonic acid at 25° C.

Step 2: Detergent feeds B1 to B6 were prepared, having compositions as described in Table 1. B1 comprised no cosmotrope or additional other salt, and is thus a comparative example. B2 to B5 comprise a cosmotrope, to form fluid compositions of the present invention. B6 comprises a salt that is not a cosmotrope, and is thus also a comparative example.

TABLE 1

| | Detergent Feed (grams) | | | | |
|---|---|---|---|---|---|
| Ingredient | B1 | B2 | B3 | B4 | B5 |
| Linear Alkylbenzene sulphonic acid (LAS) | 1.3 | 1.3 | 1.3 | 1.3 | 1.3 |
| C12-14 alkyl ethoxy 3 sulphate Mono Ethanol Amine salt | 7.2 | 7.2 | 7.2 | 7.2 | 7.2 |
| Citric acid | 1.7 | 1.7 | 1.7 | 1.7 | 1.7 |
| Grease Cleaning Alkoxylated Polyalkylenimine Polymer[1] | 0.3 | 0.3 | 0.3 | 0.3 | 0.3 |
| Soil Suspending Alkoxylated Polyalkylenimine Polymer[2] | 0.9 | 0.9 | 0.9 | 0.9 | 0.9 |
| Diethylene triamine penta acetate | 0.24 | 0.24 | 0.24 | 0.24 | 0.24 |
| Boric acid | 1.2 | 1.2 | 1.2 | 1.2 | 1.2 |
| Glycerine | 1.8 | 1.8 | 1.8 | 1.8 | 1.8 |
| Calcium formate | — | 0.5 | — | — | — |
| Calcium sulphate | — | — | 0.5 | — | — |
| Potassium chloride | — | — | — | 0.5 | — |
| Calcium nitrate | — | — | — | — | 0.5 |
| Minors: dyes, perfume, stabilizers, antifoam . . . | Up to 5 grams | | | | |

[1]600 g/mol molecular weight polyethylenimine core with 24 ethoxylate groups per —NH and 16 propoxylate groups per —NH.
[2]600 g/mol molecular weight polyethylenimine core with 20 ethoxylate groups per —NH.

Step 3: 10.7 grams of structurant premix A were slowly added to 88.3 grams of the above detergent feeds at 400 rpm, at 35° C., and the resulting mixture was adjusted to pH 8 with sodium hydroxide. The resulting mixture was allowed to cool to 25° C., before the pH sensitive ingredient (1.0 gram protease) was added under gentle stifling, at 400 rpm for 10 min. The gel strength was measured according test method C. A higher gel strength corresponds to a greater degree of structuring.

Comparative fluid composition, Ex 6, comprised no additional salt. Fluid compositions Ex 7 to Ex 9, of the present invention, comprise cosmotropes. Comparative fluid composition Ex 10 comprised a salt that is not a cosmotrope (calcium nitrate).

| | Fluid compositions | | | | |
|---|---|---|---|---|---|
| | Ex 6 comparative | Ex 7 Inventive | Ex 8 Inventive | Ex 9 Inventive | Ex 10 Comparative |
| 88.3 g Detergent Feed | B1 | B2 | B3 | B4 | B5 |
| 10.7 g structurant premix | A | A | A | A | A |
| Sodium hydroxide | to pH 8 | to pH 8 | to pH 8 | to pH 8 | to pH 8 |
| Protease[3] | 1 g | 1 g | 1 g | 1 g | 1 g |
| Gel strength (Pa) (see test method C) | 13 | 50 | 25 | 17 | 13 |

[3]Purafect Prime ®, 40.6 mg active/g.

The Gel Strength Method provides a measure of the degree of structuring provided to the fluid composition, with a higher value corresponding to an improvement in structuring. As can be seen by comparing Examples 7 to 9 with example 6 (no added salt), the cosmotrope increased the amount of structuring provided by the external structurant, to the fluid composition. In contrast, the addition of a comparative salt, which is not a cosmotrope, did not result in any increase in structuring.

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm".

What is claimed is:

1. A fluid composition, comprising:

a. an external structurant which is an amido gellant, wherein said amido gellant having the following formula:

[I]

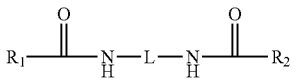

wherein: $R_1$ and $R_2$ are aminofunctional end-groups which may be the same or different, and L is a linking moiety of molecular weight from about 14 to about 500 g/mol;

b. a cosmotrope selected from the group consisting of: calcium fluoride, calcium sulphate, sodium fluoride, potassium fluoride, potassium bromide, potassium sulphate, ammonium fluoride, ammonium sulphate, tetramethylammonium bromide, tetramethylammonium fluoride, tetramethylammonium sulphate, lithium fluoride, lithium sulphate, cesium fluoride, cesium sulphate, rubidium fluoride, rubidium sulphate, rubidium bromide, and mixtures thereof, wherein the cosmotrope is present at a level of from about 0.2% to about 5% by weight of the fluid composition.

2. The fluid composition according to claim 1, wherein the composition comprises from about 0.01 wt % to about 10 wt % of the external structurant.

3. The fluid composition according to claim 1, wherein the amido gellant has a molecular weight from about 150 to about 1500 g/mol.

4. The fluid composition according to claim 1, wherein the amido gellant has a minimum gelling concentration (MGC) of from about 0.1 to about 100 mg/mL.

5. The fluid composition according to claim 1, wherein the cosmotrope is selected from the group consisting of: calcium fluoride, calcium sulphate, sodium fluoride, potassium fluoride, potassium sulphate, ammonium fluoride, ammonium sulphate, tetramethylammonium fluoride, tetramethylammonium sulphate, and mixtures thereof.

6. The fluid composition according to claim 5, wherein the cosmotrope is selected from the group consisting of: calcium fluoride, sodium fluoride, potassium fluoride, ammonium fluoride, tetramethylammonium fluoride, and mixtures thereof.

7. The fluid composition according to claim 6, wherein the cosmotrope comprises sodium fluoride.

8. The fluid composition according to claim 1, wherein the cosmotrope is present at a level of from about 0.3% to about 3% by weight of the fluid composition.

9. The fluid composition according to claim 1, wherein the fluid composition further comprises a surfactant.

10. The fluid composition according to claim 1, wherein the fluid composition further comprises less than about 30% by weight of water.

11. The fluid composition according to claim 10, wherein the fluid composition is encapsulated by a water-soluble film material comprising a polymers, copolymer or derivatives thereof selected from the group consisting of: polyvinyl alcohols, polyvinyl alcohol derivatives or copolymers, hydroxypropyl methyl cellulose (HPMC), hydroxypropyl methyl cellulose derivatives or copolymers, and combinations thereof.

12. A process for making a fluid composition according to claim 1, comprising the steps of a. providing a fluid premix comprising a solvent selected from: water, non-aminofunctional solvent, and mixtures thereof;

b. combining an external structurant selected from the group consisting of: an amido gellant, a hydrophobic ally modified ethoxylated urethane polymeric structurant, and mixtures thereof, with the fluid premix; and c. combining a cosmotrope with the fluid premix.

13. A process according to claim 12, further comprising the step of adding a surfactant to the fluid premix before step (b).

14. A process for making a unit dose article, comprising the steps of claim 12, further comprising the step of encapsulating the fluid composition in a water-soluble film, wherein the fluid composition comprises less than about 30% by weight of water.

* * * * *